US006801213B2

(12) United States Patent
Bergstrom et al.

(10) Patent No.: US 6,801,213 B2
(45) Date of Patent: Oct. 5, 2004

(54) SYSTEM AND METHOD FOR SUPERFRAME DITHERING IN A LIQUID CRYSTAL DISPLAY

(75) Inventors: Neil Bergstrom, Palo Alto, CA (US); Dick Huston, Boulder Creek, CA (US); Gang Xu, Cupertino, CA (US)

(73) Assignee: Brillian Corporation, Tempe, AZ (US)

( * ) Notice: Subject to any disclaimer, the term of this patent is extended or adjusted under 35 U.S.C. 154(b) by 262 days.

(21) Appl. No.: 09/792,041

(22) Filed: Feb. 21, 2001

(65) Prior Publication Data

US 2002/0000994 A1 Jan. 3, 2002

Related U.S. Application Data

(60) Provisional application No. 60/197,133, filed on Apr. 14, 2000.

(51) Int. Cl.[7] ..... G09G 5/02

(52) U.S. Cl. ..... 345/596; 345/591; 345/600; 345/593; 345/597; 345/88; 345/102

(58) Field of Search ..... 345/591, 593, 345/596, 597, 600, 88, 102

(56) References Cited

U.S. PATENT DOCUMENTS

| | | | | |
|---|---|---|---|---|
| 4,361,043 | A | 11/1982 | Engle | 73/620 |
| 4,524,447 | A | 6/1985 | Willis et al. | 375/26 |
| 5,374,963 | A | 12/1994 | Willis | 348/564 |
| 5,389,948 | A | 2/1995 | Liu | 345/147 |
| 5,451,978 | A | 9/1995 | Harju | 345/78 |
| 5,604,510 | A | 2/1997 | Blanchard | 345/98 |
| 5,652,600 | A | 7/1997 | Khormaei et al. | 345/76 |
| 5,920,298 | A | 7/1999 | McKnight | 345/87 |
| 5,920,305 | A | 7/1999 | Yoon | 345/153 |
| 6,008,794 | A | 12/1999 | Ishii | 345/150 |
| 6,081,252 | A | 6/2000 | Reddy | 345/153 |
| 6,104,367 | A | 8/2000 | McKnight | 345/94 |
| 6,147,671 | A | 11/2000 | Agarwal | 345/149 |
| 6,172,629 | B1 | 1/2001 | Fetterman | 341/131 |
| 6,310,591 | B1 | 10/2001 | Morgan et al. | 345/84 |
| 6,362,834 | B2 | 3/2002 | Ishii | 345/690 |
| 6,417,864 | B1 | 7/2002 | Jones et al. | 345/596 |
| 6,452,589 | B1 * | 9/2002 | McKnight | 345/205 |

FOREIGN PATENT DOCUMENTS

| | | |
|---|---|---|
| WO | 98/27537 | 6/1998 |
| WO | 98/27538 | 6/1998 |
| WO | 98/27540 | 6/1998 |

OTHER PUBLICATIONS

Ghosh, Amal; "Strategies for Colored Oled Microdisplays", Feb. 2, 2000, eMagin Corporation.

* cited by examiner

*Primary Examiner*—Kee M. Tung
*Assistant Examiner*—Tam Tran
(74) *Attorney, Agent, or Firm*—Baker Botts L.L.P.

(57) ABSTRACT

A system and method are provided for driving a digital display adapted to depict a first number of bits per color field during each frame. In use, a second number of bits is displayed which is greater than the first number of bits. This is accomplished by alternating the display of the bits between frames. To this end, additional bits of color are displayed without increasing the number of bits per color field during each frame.

10 Claims, 32 Drawing Sheets

MSB Most Significant bit
SSB Second Significant bit
LSB Least Significant bit

| | | | | | | | |
|---|---|---|---|---|---|---|---|
| W | C | M | B | Y | G | R | BK |
| BK | W | C | M | B | Y | G | R |
| R | BK | W | C | M | B | Y | G |
| G | R | BK | W | C | M | B | Y |
| Y | G | R | BK | W | C | M | B |
| B | Y | G | R | BK | W | C | M |
| M | B | Y | G | R | BK | W | C |
| C | M | B | Y | G | R | BK | W |

Original Scroll Region

Key

| B | G | R | Color | Pixel |
|---|---|---|---|---|
| 0 | 0 | 0 | White | W |
| 0 | 0 | 1 | Cyan | C |
| 0 | 1 | 0 | Magenta | M |
| 0 | 1 | 1 | Blue | B |
| 1 | 0 | 0 | Yellow | Y |
| 1 | 0 | 1 | Green | G |
| 1 | 1 | 0 | Red | R |
| 1 | 1 | 1 | Black | BK |

| | | | | | | | |
|---|---|---|---|---|---|---|---|
| W | C | W | C | M | B | Y | G |
| BK | W | BK | W | C | M | B | Y |
| B | BK | R | BK | W | C | M | B |
| G | R | G | R | BK | W | C | M |
| Y | G | Y | G | R | BK | W | C |
| R | Y | R | Y | G | R | BK | W |
| M | R | M | R | Y | G | R | BK |
| C | M | C | M | R | Y | G | R |

Scroll Left

| | | | | | | | |
|---|---|---|---|---|---|---|---|
| BK | W | C | M | B | Y | G | R |
| R | BK | W | C | M | B | Y | G |
| G | R | BK | W | C | M | B | Y |
| Y | G | R | BK | W | C | M | B |
| B | Y | G | R | BK | W | C | M |
| M | B | Y | G | R | BK | W | C |
| C | M | B | Y | G | R | BK | W |
| C | M | B | Y | G | R | BK | W |

Scroll Down

| | | | | | | | |
|---|---|---|---|---|---|---|---|
| W | C | M | B | Y | C | R | BK |
| W | C | M | B | Y | C | R | BK |
| BK | W | C | M | B | Y | C | R |
| R | BK | W | C | M | B | Y | C |
| G | R | BK | W | C | M | B | Y |
| Y | G | R | BK | W | C | M | B |
| B | Y | G | R | BK | W | C | M |
| M | B | Y | G | R | BK | W | C |

Scroll Up

| | | | | | | | |
|---|---|---|---|---|---|---|---|
| M | B | Y | G | R | BK | R | BK |
| C | M | B | Y | G | R | G | R |
| W | C | M | B | Y | G | Y | G |
| BK | W | C | M | B | Y | B | Y |
| R | BK | W | C | M | B | M | B |
| G | R | BK | W | C | M | C | M |
| Y | G | R | BK | W | C | W | C |
| B | Y | G | R | BK | W | BK | W |

Scroll Right

*Figure 15B*

Columns

| | | | | |
|---|---|---|---|---|
| | A | B | A | B |
| Rows | B | A | B | A |
| | A | B | A | B |

*Figure 26*

Columns

Rows

| | | | | | | | |
|---|---|---|---|---|---|---|---|
| A | B | C | D | A | B | C | D |
| C | D | A | B | C | D | A | B |
| B | A | D | C | B | A | D | C |
| D | C | B | A | D | C | B | A |
| A | B | C | D | A | B | C | D |
| C | D | A | B | C | D | A | B |

*Figure 27*

SYSTEM AND METHOD FOR SUPERFRAME DITHERING IN A LIQUID CRYSTAL DISPLAY

PRIOR APPLICATIONS

This application claims priority from U.S. provisional Application No. 60/197,133 entitled COLOR AND GRAYSCALE GENERATION METHODS FOR DIGITAL DISPLAYS filed on Apr. 14, 2000 and which is herein incorporated by reference.

FIELD OF THE INVENTION

The present invention relates to a display system for producing an image and more specifically to methods for applying digital information to generate color and grayscale.

BACKGROUND OF THE INVENTION

A continuing objective in the field of electronics is the miniaturization of electronic devices. Most electronic devices include an electronic display. As a result, the miniaturization of electronic displays is critical to the production of a wide variety of compact electronic devices. For example, as electronic devices such as personal digital assistants, cell phones, digital still cameras, DVD players and internet appliances become ever smaller and more portable, the demands on the electronic displays for these products must meet difficult and seemingly contradictory requirements. On the one hand, the displays must provide increasing amounts of high quality visual information, sometimes approaching that of a desktop monitor. Yet these displays must still be very compact and lightweight, consume little power, and be produced at low cost. Until recently, displays were not able to meet all of these requirements.

The purpose of an electronic display is to provide the eye with a visual image of certain information. This image may be provided by constructing an image plane composed of an array of picture elements (or pixels) which are independently controlled as to the color and intensity of the light emanating from each pixel. The electronic display is generally distinguished by the characteristic that an electronic signal is transmitted to each pixel to control the light characteristics which determine the pattern of light from the pixel array which forms the image.

Two examples of electronic displays are the cathode ray tube (CRT) and the active-matrix liquid crystal display (AMLCD). There are other electronic displays, but none are so well developed as the CRT and AMLCD which are used extensively in computer monitors, televisions, and electronic instrument panels. The CRT is an emissive display in which light is created through an electron beam exciting a phosphor which in turn emits light visible to the eye. Electric fields are used to scan the electron beam in a raster fashion over the array of pixels formed by the phosphors on the face plate of the electron tube. The intensity of the electron beam is varied in an analog (continuous) fashion as the beam is swept across the image plane, thus creating the pattern of light intensity which forms the visible image. In a color CRT, three electron beams are simultaneously scanned to independently excite three different color phosphors respectively which are grouped into a triad at each pixel location.

In contrast to the emissive type displays such as the CRT, an AMLCD display utilizes a lamp to uniformly illuminate the image plane which is formed by a thin layer of liquid crystal material laminated between two transparent conductive surfaces which are comprised of a pattern of individual capacitors to create the pixel array. The intensity of the illumination light transmitted through each pixel is controlled by the voltage across the capacitor, which is in turn controlled by an active transistor circuit connected to each pixel. This matrix of transistors (the active matrix) distinguish the AMLCD from the passive matrix liquid crystal devices which are strictly an array of conductors controlled by transistors external to the image area usually in the periphery of the matrix. The ability of each transistor to control the characteristics of just one pixel allows for the higher performance found in AMLCD displays in contrast to the passive arrays.

In AMLCD displays, the electronic signals which control the images are transmitted to the pixel from driver circuits along the edges of the rows and columns. Typically when a row of image data has been assembled in the form of an analog voltage signal at each column driver at the edge of the columns, an enabling signal to the corresponding row driver activates the transistor connected to each pixel in that row to pass the voltage onto the capacitor forming the pixel. This storage mechanism is similar to dynamic memory cells (DRAM) although the cells are typically addressed serially (rasterwise) rather than randomly as DRAM implies.

In most displays, the electronic activation of the image must be continuous or persistent through repetition. In the CRT and emissive displays in general, a constant or highly repetitive source of energy must be applied to the pixel to create photon emission. Phosphor decay times are typically a few milliseconds. Similarly, the capacitors in the AMLCD array lose their charge through leakage and accurate grayscale levels are lost. Furthermore, many liquid crystal materials exhibition migration and must be reversed in polarity with each refresh cycle. In general, displays with limited persistence must be refreshed frequently to avoid noticeable brightness variation known as flicker. On the other hand, displays with substantial persistence cannot display moving images without ghost images. Refreshing the image of most displays requires repeated transmission of the image data to the display, either from the broadcast source or from a storage device.

Not all electronic products which contain an electronic display have memory for storing the data which is to be displayed. For instance, a television must activate the CRT display in real time as the broadcast signal is received unless a VCR or similar storage medium is employed. In computers, data is transmitted and stored digitally. Moreover, in portable electronics devices, size and power constraints require the use of semiconductor memory which stores data only in digital format. In digital electronic products, it is typical that a display controller is incorporated to receive and store the bit mapped image to be displayed and then to transfer that data to the display in a series of image frames at a rate high enough to look smooth to the eye. The semiconductor memory storing the image bits is called the frame buffer, and the rate at which the data is refreshed on the display is called the frame rate.

It is an advantage in many applications to display large amounts of information requiring more and more resolution in the display. High resolution displays may contain hundreds of thousands of pixels. As an example, the Super VGA (SVGA) display resolution consists of 480,000 pixels. With a simple monochrome image and no grayscale, the frame storage is only equal to the approximately one-half megabit frame size. However, were the image to be full 24 bit depth color (i.e., 3 colors and 8 bits of grayscale per color), the frame storage would approach 12 megabits. At the frame rates which are common today for high performance displays, at least 60 frames per second, and up to 85 frames per second, as many as one gigabits per second must be transferred from the frame buffer to the display. The state of semiconductor technology at present limits clock speeds to a level well below such transfer rates and parallel interfaces of 16 to 32 bit widths are typical in high performance displays.

It is a characteristic of analog displays that when the image data is stored in semiconductors, the digital information is converted to analog in a digital-to-analog converter (DAC) at the interface of the display. The digital representation of a pixel at the high standard of 8 bits of grayscale allows the creation of 256 separate shades per color (16 million distinct colors). In high performance displays, multiple DAC channels are required to provide the bandwidth of data transfer required.

As was noted above, most displays must be frequently rewritten to maintain an image. In the case of both CRT and AMLCD displays, data is being rewritten to one part of the display area while the rest of the array continues to display the prior image frame. This property is particular to monochrome displays and to color images are created from a composite of spatially separated sub-pixels. There is a clear advantage to writing and displaying data at the same time allowing each function to make maximum utilization of time allowed for each frame.

Once data corresponding to an image is transferred to a display via electronic signals, there is an advantage to the display device being able to maintain the image unless a portion of the image must be altered to provide motion to the image. The amount of data written to the display in each subsequent frame can be substantially reduced if the writing operation is organized to be random, such as to write data to any location in the array and only to those locations where the data is changing for reasons that the image is moving or for reasons the array is reused sequentially to create a composite image. To achieve this end however, pixel locations which are not being rewritten must be able to store data and continually display it.

There exists a class of displays; primarily micro electromechanical system (MEMS) electromechanical devices and certain polymeric dispersed cholesteric liquid crystals, which are inherently bistable due to nonlinearities of the electro-optic response curve. In these displays, image storage within the device itself can be indefinite although without color or grayscale. Further, such devices cannot inherently provide grayscale in response to analog signals. However, grayscale can be achieved through time division of the image frame into a multiplicity of on and off states which on average provide a shade proportional to the signal pattern.

Similarly, in an active matrix display a multiplicity of transistors may be provided in correspondence to each pixel such that a static memory (SRAM) cell (typically four or six transistors) can be utilized to activate each pixel. There are several advantages to static memory such as the on-state output voltage always being at the rail voltage, the low activation current, no voltage decay, and sufficient signal to noise to read from the memory cells any stored data. However, because a static memory cell is itself bistable, the pixel activation will provide no analog grayscale.

In general, displays with no analog response fall into three categories. Those displays with an extremely fast response in relation to the time divisions of the on-off cycles (as is typical of MEMS devices) can achieve grayscale through pulse width modulation. This modulation can be a modulation of the liquid crystal response while the illuminating pulse is held constant or a modulation of the illumination duration while the liquid crystal is controlled to be either on or off during the period of illumination. Those displays with a relatively slow response time in relation to on-off cycles (as is typical of liquid crystal devices) can achieve grayscale through a root mean square (RMS) voltage level based on the average time-voltage product. For display systems not falling into either of these special cases, a variety of alternative schemes may be employed. The inventions described herein will present several methods to provide high quality color display operation in these circumstances. In all cases however, there is a disadvantage in comparison to analog grayscale methodologies, that being the loss of parallelism of the data transfer of the grayscale bits. Data transfer rates from frame buffers to a binary display device can be significantly higher than an analog display. There are two methods commonly used to generate color using a single electro-optic device. In the first, each picture element (pixel) is divided into three or more sub-pixels and a color filter, typically red, green and blue, is placed in the light path from each sub-pixel. The eye merges these sub-pixels to create a color image. This method suffers from significant light loss in the color filters, requiring up to four times as much power to be supplied to the illumination system. The color filters also add significant additional cost to the display. The second method avoids the high power requirement and added cost of the sub-pixel/color filter method. Instead, a single pixel is used for red green and blue images in a sequential manner.

The pixel sizes are also small relative to the size of color filters used in TFT AMLCD displays to create color triads for each pixel. There is a significant advantage to creating color through the sequential use of the entire array to create an image specific to each of the three prime color components. Through the utilization of separate light emitting diodes (LEDs) of each prime color to illuminate the display, the diodes can be turned rapidly on and off to correspond to the particular color component being displayed by the array at that moment. This method of color creation is called field sequential color wherein each color field is sequentially illuminated by the appropriate diode. Because at least three different color field images need to be displayed at a rate faster than can be resolved by the eye, the field sequential color method at least triples the data transfer rate required as compared to a monochrome display.

A need exists for a display system which can overcome the various above-described limitations of prior art display systems and be able to produce a high resolution field sequential color image which is not limited by the frame transfer rate limitations of existing display matrices. The display system should also be adaptable for use as a micro-display.

In AMLCD panels, red, green and blue levels are stored into the array as analog voltage levels. These levels control directly the voltage applied to liquid crystal between pixel and ITO layer to produce the various shades of color under constant illumination. The voltage level of each pixel is maintained by the active-matrix circuit until a new value is applied to the pixel.

Red, green, and blue component sub-pixels are simultaneously applied to the Liquid Crystal (LC) as a group to form a single pixel. Variations in color response of the LC is accounted for in each pixel, rather than by different voltage levels of ITO.

Binary control of LC avoids many complications of analog drive methods.

Analog control is far more sensitive to variations in cell gap, temperature, and LC contaminates, requiring high levels of quality control during manufacture.

However, binary methods have inherently been more limited in terms of color depth due to optical response time of ordinary LC. What is needed is a system and method of driving the aforementioned displays that overcomes the disadvantages inherent in the prior art. These and other advantages are provided by the display systems of the present invention.

SUMMARY OF THE INVENTION

A display matrix is provided for forming a composite image from a series of sub-images. In general, the display matrix includes a plurality of display elements, each display element including a pixel, and a display circuit electrically connected to the pixel. Each display circuit includes a plurality of memory cells, and a selector for outputting to the pixel data from one memory cell at a time.

According to one aspect of the display matrix of the present invention, a plurality of memory cells in the display circuit are continuously electrically connected to the selector of the display circuit at the same time. As a result, there is no need to address a particular memory cell to a particular selector. This may be accomplished, for example, by the display circuit including separate conductive elements for each memory cell in the display matrix which electrically connects a memory cell to the selector in the display circuit.

According to another aspect of the display matrix of the present invention, the display matrix is formed on a substrate having a plurality of regions where each region includes a memory circuit with a plurality of memory cells, and a selector electrically connected to the plurality of memory cells in the region. The substrate may be any material on which the display circuit may be attached or formed. In a preferred embodiment, the substrate is a semiconductor, such as silicon, on which the display circuits are formed by one or more of a variety of methods known in the art.

According to this aspect, the memory cells are physically inter-dispersed among the selectors within the plurality of display elements. In this regard, the memory associated with the display matrix is integrated into the display matrix as opposed to be external to the display matrix and the selectors.

According to the present invention, at least a portion of the display circuits of the display matrix include at least 2 memory cells per display circuit. In one embodiment, at least a portion of the display circuits of the display matrix include at least 3 memory cells per display circuit. The display matrix may optionally include 4–18 or more memory cells per display circuit, depending on a variety of factors which will be discussed herein.

In a preferred embodiment, the display matrix has sufficient memory such that data can be transferred to the display matrix for one sub-image while a different sub-image is displayed. The display matrix may also have sufficient memory to display two or more different sub-images without having to write to the memory cells between displaying the different sub-images. The plurality of memory cells in each circuit can represent different bits of a digital grayscale value. It is possible to vary the digital grayscale value significance of a particular memory cell image to image and field to field. The plurality of memory cells in each circuit can represent bits of different color fields.

In one embodiment, the display circuit can be operated in a field sequential color (FSC) mode without having to write to the memory cells between displaying different fields. This enables the display matrix to not need an external frame buffer. The display matrix may optionally be configured to be operated in a field sequential color (FSC) mode without having to write to the memory cells between displaying different fields.

Data preferably can be both written to and read from the memory cells. In one embodiment, data for forming a sub-image can be written randomly to the memory cells. In a particular variation, the memory cells are static random access memory (SRAM) cells.

In one embodiment, the display matrix is sized to form a microdisplay. According to this variation, the pixels in the plurality of display elements may form a source object having an area equal to or less than about 400 $mm^2$ and preferably between about 20 $mm^2$ and 100 $mm^2$. The pixels of the display matrix preferably have an area less than about 0.01 mm2 and more preferably between 50 $m^2$ and 500 $m^2$.

The present invention also relates to a display system which includes a display matrix according to the present invention and peripheral control circuits for controlling read and write operations to the memory cells. The display system may also include an illumination source for illuminating the pixels. In one embodiment, the display includes a light emitting mechanism provided at each pixel. The display system may also include a light modulating mechanism, such as a liquid crystal material, provided at each pixel.

The display system may optionally further include logic for reading, inverting and rewriting data stored in the memory cells to provide a refresh cycle, a processor for reading, modifying, and rewriting data stored in the memory cells to compose a bit mapped image without the need of an external frame buffer, control circuits for reading, modifying, and rewriting data stored in the memory cells to provide a cursor function. The peripheral control circuits may also serve to read, move, and rewrite data stored in the memory cells to provide a scroll function.

The display system may also include an illumination source capable of providing a plurality of different color illumination to the pixels, the particular color illumination provided to the pixels being coordinated by the peripheral control circuits with the read and write operations to the memory cells. Two, three or more different colors of illumination may be provided. The illumination source preferably provides at least three different colors of illumination.

The display matrices and display systems of the present invention may be used in a display component of a variety of electronic devices. Examples of such devices include, but are not limited to portable computers, personal communicators, personal digital assistants, modems, pagers, video and camera viewfinders, mobile phones, and television monitors. In one particular embodiment, the display matrices and display systems of the present invention are used in combination with one or more magnification optics to form a virtual image display system.

The present invention also relates to methods of using the display matrices and display systems of the present invention to produce composite images as described herein.

In an embodiment of the present invention, a system and method are provided for driving a digital display adapted to depict a first number of bits per color field during each frame. In use, a second number of bits is displayed which is greater than the first number of bits. This is accomplished by alternating the display of the bits between frames. To this end, additional bits of color are displayed without increasing the number of bits per color field during each frame.

In operation, N+M bits of color may be displayed using N digital bits per color field. Further, additional color may be applied in a spatially distributed manner to reduce the amount of brightness modulation that is observed. As an option, an additional color bit may be calculated based on the value of the preceding bit being added to every other frame. Moreover, a given frame may not be displayed which results in a reduction of a perceived intensity modulation and flicker reduction.

Methods will also be described for augmenting the display system with additional integrated circuits and firmware that can provide color and grayscale displays of various color depth.

BRIEF DESCRIPTION OF THE DRAWINGS

FIG. 15B illustrates an address map which can scroll pixel by pixel.

FIG. 26 illustrates spatially distributed phases for 1 bit of temporal color.

FIG. 27 illustrates spatially distributed phases for 2 bits of temporal color.

DESCRIPTION OF THE PREFERRED EMBODIMENTS

The present invention relates to a display matrix for forming sequentially formed composite images. As used herein, a sequentially formed composite image is an image formed by displaying a series of two or more different sub-images to an observer where the different sub-images are displayed one sub-image at a time on the display matrix. These display matrices can be used in a display system component of a variety of electronic devices. Examples of such devices include, but are not limited to portable computers, personal communicators, personal digital assistants, modems, pagers, video and camera viewfinders, mobile phones, and television monitors. In one particular embodiment, the display matrices and display systems of the present invention are used in combination with one or more magnification optics to form a virtual image display system.

A unique property of the display matrix of the present invention is that data for a plurality of sub-images may be stored in the display matrix simultaneously. This property eases the instantaneous bandwidth requirements of the display matrix and, in certain situations, actually decreases the amount of data which must be transferred to the display matrix from external memory locations.

In general, a display system forms a sequentially formed composite image by displaying a series of sub-images to an observer at a rate preferably faster than the eye of the observer can resolve. Image quality is reduced if the eye is able to perceive an individual field sub-image, a phenomena known as flicker. In practice, it has been found that frame rates in excess of 60 Hz are necessary to avoid flicker.

Ideally, the data for any sub-image should be present in the display matrix from the beginning until the end of the display of the sub-image. If the display matrix houses only a single sub-image at a time, then ideally the entire data transfer should take place between the display of one sub-image and the next. This places high instantaneous bandwidth requirements on the system in order to transfer all of the data for a sub-image in the interval between the display of sub-images.

Figure 1:
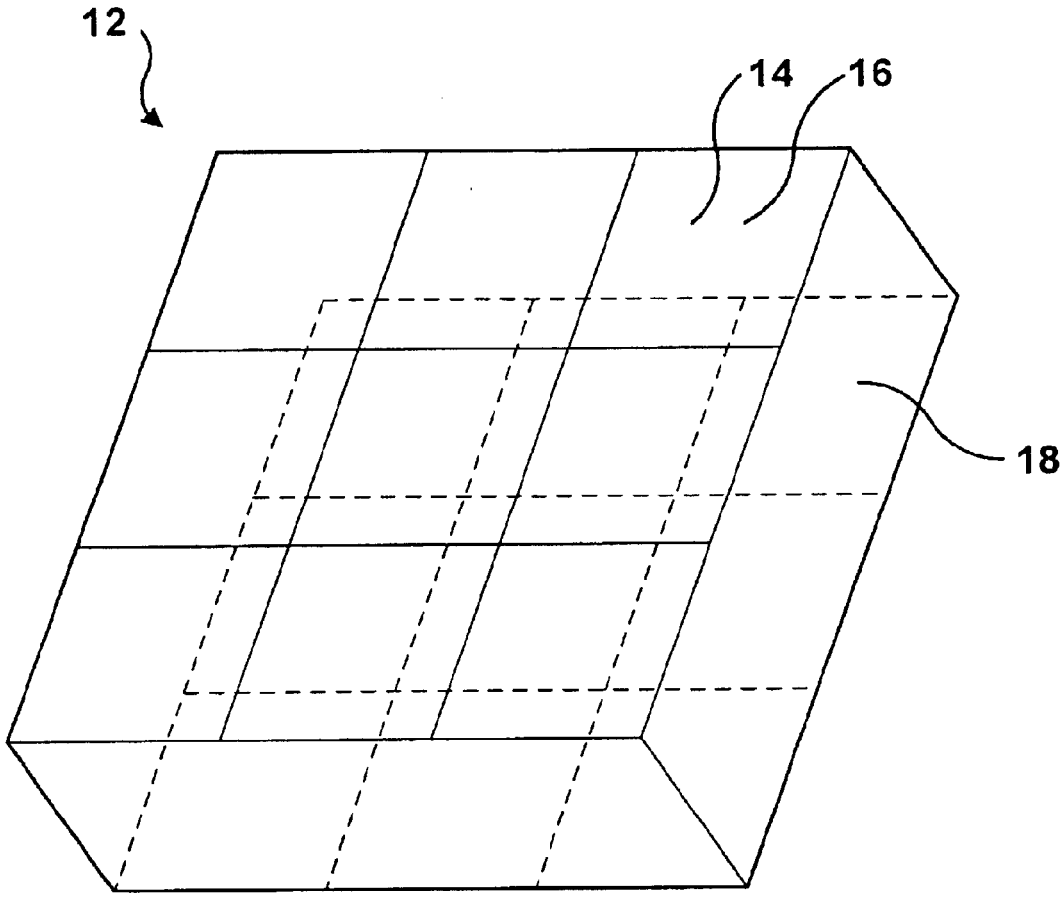
FIG. 1 illustrates a display matrix.

FIG. 1 illustrates a typical display matrix 12 which includes a plurality of display elements 14. Each display element 14 includes a pixel 16 and a display circuit 18 which is electrically connected to the pixel and controls the operation of the pixel 16. The plurality of pixels incorporated into the plurality of display elements together form the source object formed by the display matrix 12.

In a display matrix according to the present invention, the display circuit consists of a plurality of memory cells and a selector. The selector is able to output to the pixel the contents of at most one memory cell at any instant. The selector is controlled by additional input signals provided to the display circuit.

Figure 2:
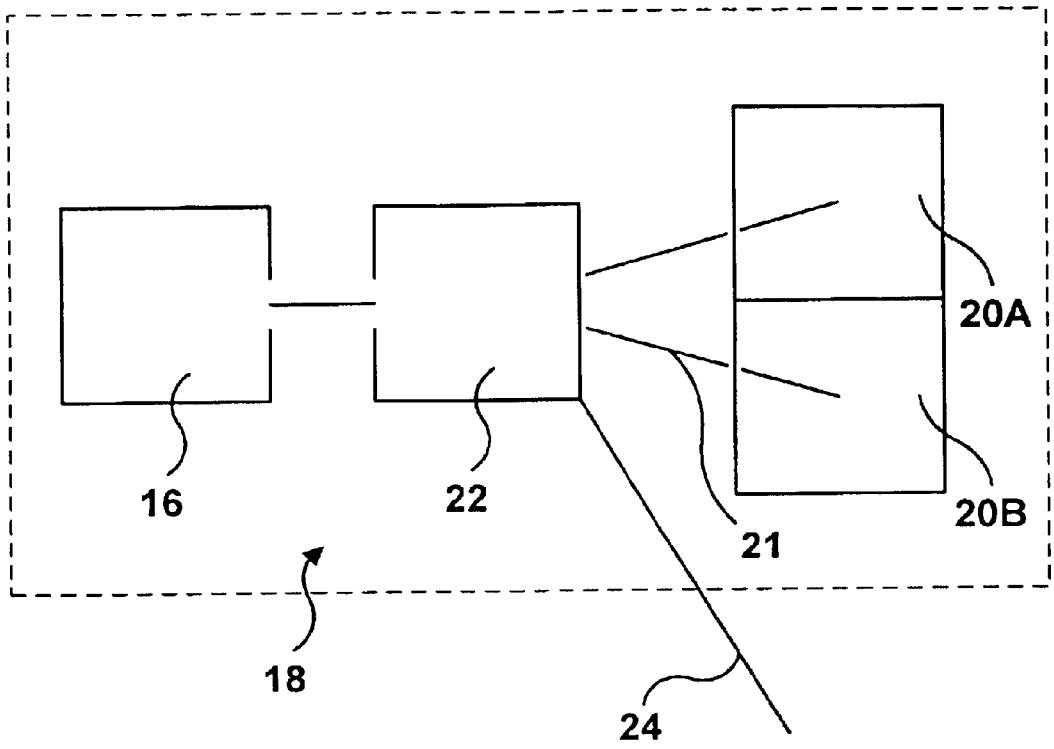
FIG. 2 illustrates a display circuit which may be used in the display matrix of the present invention.

FIG. 2 illustrates a display circuit 18 which may be used in the display matrix of the present invention. As illustrated, the display circuit 18 includes a plurality of memory cells 20A, 20B (two shown) which are each electrically connected to a selector 22. The selector controls which memory cell is electrically connected to the pixel 16. As illustrated, the display circuit 18 can also optionally receive one or more inputs 24 for controlling the operation of the selector 22.

As illustrated in FIG. 2, a feature of the display circuit and display matrix of the present invention is that a plurality of the memory cells in the display circuit are continuously electrically connected to the selector of the display circuit at the same time. As a result, there is no need to address a particular memory cell to a particular selector. This may be accomplished, as illustrated in FIG. 2, by the display circuit including separate conductive elements 21 for each memory cell in the display matrix which electrically connects a memory cell to the selector in the display circuit. The figure illustrates that all the memory cells in the display circuit are connected. It is noted that less than all of the memory cells may optionally be continuously electrically connected.

A further feature of the display circuit and display matrix of the present invention is that the display matrix is formed on a substrate having a plurality of regions where each region includes a memory circuit with a plurality of memory cells, and a selector electrically connected to each memory cell in the region. For example, FIG. 1 illustrates a plurality of display circuits in separate regions. By having a plurality of regions which each include a complete memory circuit, a display matrix is provided where the memory cells are physically inter-dispersed among the selectors within the display matrix. This distinguishes the display matrix of the present invention over prior art displays with an external frame buffer. The substrate may be any material on which the display circuit may be attached or formed. In a preferred embodiment, the substrate is a semiconductor, such as silicon, on which the display circuits are formed by one or more of a variety of methods known in the art.

Yet a further feature of the display matrix of the present is its ability to store more than one image at a time. Because the display circuit 18 has more than one memory cell per pixel, it is possible to display two or more different sub-images without having to write to the memory cells between displaying the different sub-images. In addition, data may be transferred to the display matrix for one sub-image while a different sub-image is displayed. Accordingly, the data transfer time for one sub-image can be spread over the entire display time of a different sub-image. This alleviates the need for a high instantaneous bandwidth or a high sub-image display rate, a clear advantage over prior art display systems.

Figure 3:
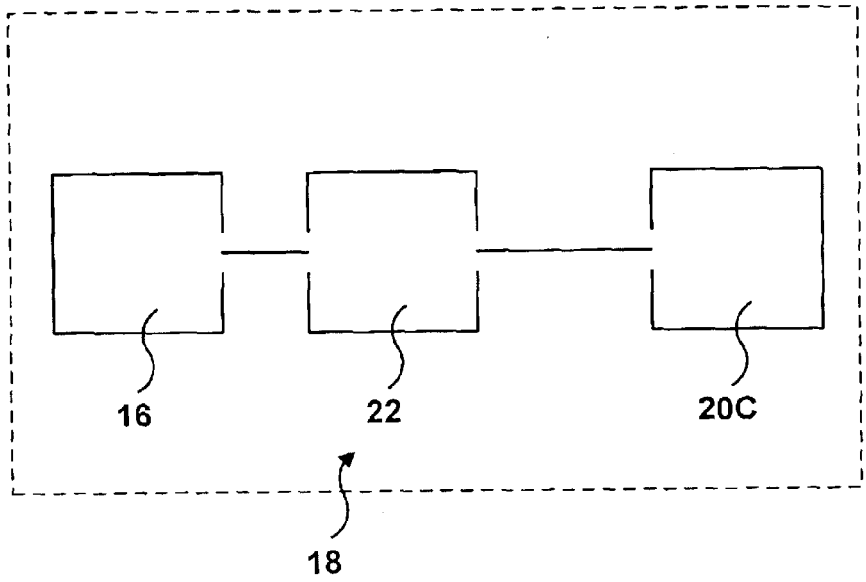
FIG. 3 illustrates a prior art display circuit.

FIG. 3 illustrates a prior art display circuit. As illustrated in FIG. 3, the prior art display circuit includes a single memory cell 20C which is connected to pixel 16. The prior art display circuit thus does not need a selector or input for controlling the operation of the selector. Further, because the display circuit only includes one memory cell 20C, a memory matrix employing this display circuit can only store data for one sub-image and thus cannot display different sub-images without having to write to the memory cells between displaying the different sub-images. When it is necessary to create an image out of a composite of sub-images, the sub-images are typically composed in a spatial relationship and written simultaneously to the matrix.

The display matrix of the present invention may be any addressable display which includes a pixel and a display circuit which controls the operation of the pixel in response to control signals. As used herein, a pixel (a contraction of picture element) refers to any mechanism which can either emit light or modulate incident light in response to an electrical field to form one element of a source object. The plurality of pixels incorporated into the plurality of display elements together form the source object formed by the display matrix.

Examples of suitable pixels include but are not limited to the pixels used in liquid crystal displays, spatial light modulators, gratings, mirror light valves, and LED arrays. The pixels can be opaque or light transmissive. Opaque pixels can be further divided into reflective, emissive, and scattering pixels.

In one embodiment of the present invention, the pixels used in the display matrix are sized to be a microdisplay. As used herein, a microdisplay refers to a display matrix which is used in a virtual image display system to form a source object which is then magnified by one or more magnification optics to form a magnified virtual image. In a preferred embodiment, the microdisplay forms a source object having an area equal to or less than about 400 $mm^2$. In one embodiment, the source object has an area between about 10 $mm^2$ and 400 $mm^2$, more preferably between about 20 $mm^2$ and 100 $mm^2$. The pixels of the display matrix preferably have an area less than about 0.01 $mm^2$ and more preferably between 50 $m^2$ and 500 $m^2$.

By designing a microdisplay to include a display circuit according to the present invention, microdisplays with reduced instantaneous bandwidth requirements and reduced average bandwidth are provided. The reduced bandwidth requirements translate into lower power consumption, which is particularly important for battery-powered applications in devices which incorporate microdisplays.

In one particular embodiment, a microdisplay is provided which includes a liquid crystal device (LCD) and operates in either reflective or scattering modes.

Figure 4A:
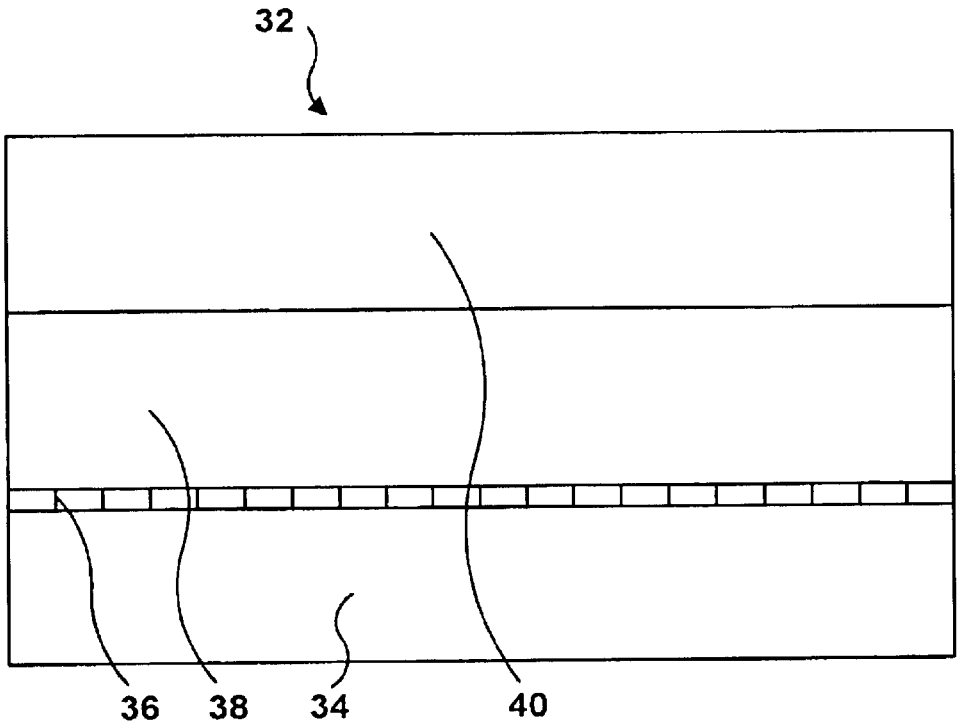
FIG. 4A illustrates a cross-sectional view of a liquid crystal device.
Figure 4B:
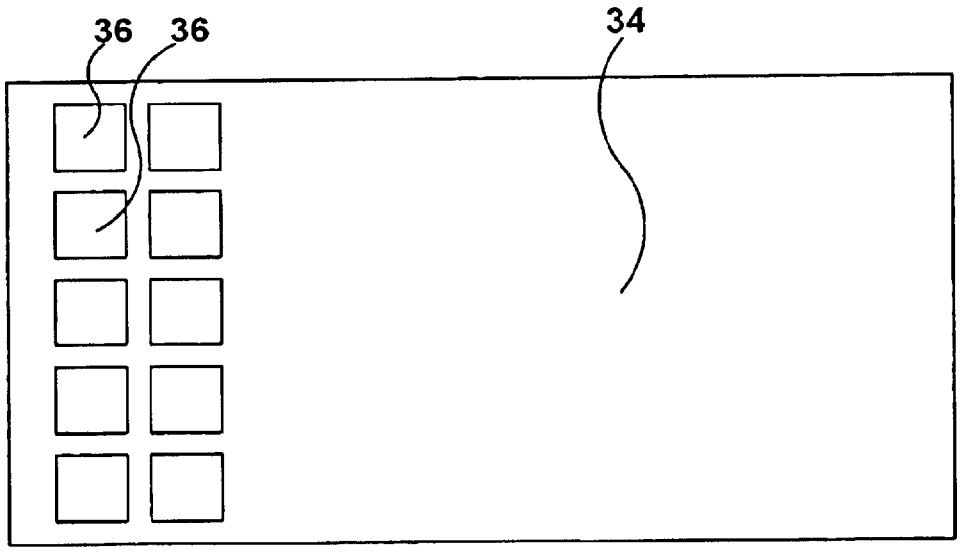
FIG. 4B illustrates a top-down view of a liquid crystal device.

FIG. 4A illustrates a cross-sectional view of a liquid crystal device while FIG. 4B illustrates a top-down view of a liquid crystal device. As illustrated in FIGS. 4A and 4B, the LCD 32 is composed of a substrate 34 having a plurality of electrodes 36 corresponding to pixels, liquid crystal 38 arranged on the substrate 34, and a counter electrode 40 arranged on the liquid crystal 38. The liquid crystal is caused to align or relax at each pixel in response to local electric fields applied across the liquid crystal between the pixel and the counter electrode. The potential at each pixel on the substrate is determined by the corresponding display circuit, the design of which is the subject of the present invention. Sequentially changing the potentials at any or all of the pixels on the substrate via the corresponding display circuits causes the LCD as a whole to form a composite image when properly illuminated.

According to this embodiment, a sub-image is observed when the LCD is illuminated after allowing sufficient time for the liquid crystal to align or relax according to the voltage pattern on the pixels. A multicolor image may be produced by performing the following sequence sequentially with different colored illumination sources: (1) turning off illumination; (2) stimulating the liquid crystal with a voltage pattern on the pixels for a first sub-image or field; (3) waiting a sufficient period of time for the liquid crystal to form the source object; and (4) illuminating the liquid crystal. The above sequence is repeated for each light source present.

Figure 5:
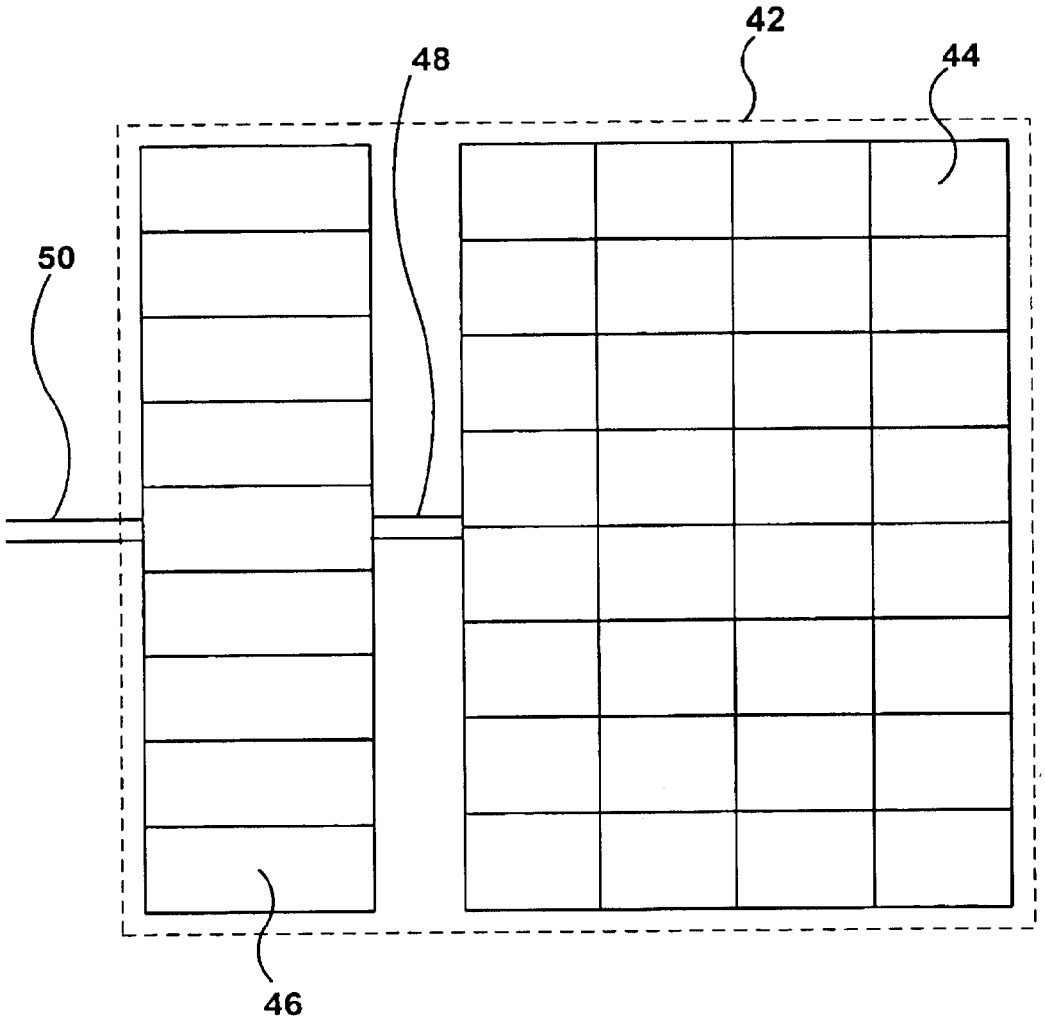
FIG. 5 illustrates a backplane integrated circuit (backplane IC) which may be used in a display matrix of the present invention.

FIG. 5 illustrates a backplane integrated circuit (backplane IC) which may be used in a display matrix such as a LCD microdisplay. As illustrated, the backplane IC 42 integrates into a single electronic circuit a display matrix 44, programmable registers 46 that generate the control signal logic 48 provided to the display matrix 44 and other timing functions, and an interface 50 to a source of image data. A display matrix for this backplane IC may be sized to include an 800 by 600 two-dimensional array of display circuits.

The display circuit for a backplane IC according to the present invention is composed of two or more memory cells and a selector circuit. The memory cells may be conventional Static Random Access Memory (SRAM) cells composed of six transistors each, though the use of other digital memory cells is intended to fall within the scope of the present invention.

Using SRAM for the memory cells facilitates fabrication of the IC. SRAM can be fabricated by the same process steps and fabrication tools as the selector circuit. For example, the selector and SRAM may be formed on a substrate with one poly-silicon layer and three or four metal layers, 1p3m or 1p4m. This obviates the need for different fabrication processes for the memory and logic components of the IC, and reduces the number of mask levels required in fabrication.

As an example of a display circuit, in a three color system, the SRAM cells may be called RED CELL, GREEN CELL, and BLUE CELL, respectively. The cells are addressed for reading and writing via WORD signals. Data is transferred into and out of the SRAM cells via BIT and BIT BAR signals.

There are two basic configurations of the three SRAM cells. The cells can share the BIT and BIT BAR data signals and have separate address signals, possibly named RED WORD, GREEN WORD, and BLUE WORD, respectively. Or the cells can share a WORD address line and have separate data signals, such as RED BIT and RED BIT BAR, etc.

The selector is accomplished with switches that connect the SRAM cells to the pixel at the output of the display circuit. The switches may be pass gates controlled by RED STROBE, GREEN STROBE, and BLUE STROBE signals, respectively. When the RED STROBE signal is asserted, the voltage stored in the RED CELL is transferred to the pixel. The GREEN STROBE and BLUE STROBE signals operate analogously. The various WORD and STROBE signals are provided to each display circuit based on programmable registers inside the backplane IC but outside the display matrix.

When the RED STROBE is asserted over the entire display matrix, a voltage pattern corresponding to the data stored in the RED CELL of every display circuit is output on the pixels. The GREEN STROBE and BLUE STROBE signals operate analogously.

In an embodiment of the present invention, each cell is connected to a individual strobe line. This design allows each cell to be strobed individually, thereby minimizing the power consumed in the operation of the display system and optimizing the operation speed of the display.

In an alternative embodiment, multiple cells are connected to individual strobe lines. This design reduces the wiring density of the IC. By varying the number of strobe lines used, the display system can be designed to have a desired level of wiring density. It is noted that power efficiency and operation speed decrease as wiring density decreases. The particular wiring density that is preferred will depend upon the particular application for which the display is being designed and the wiring density, power efficiency, and operation speed that are required.

Figure 6:
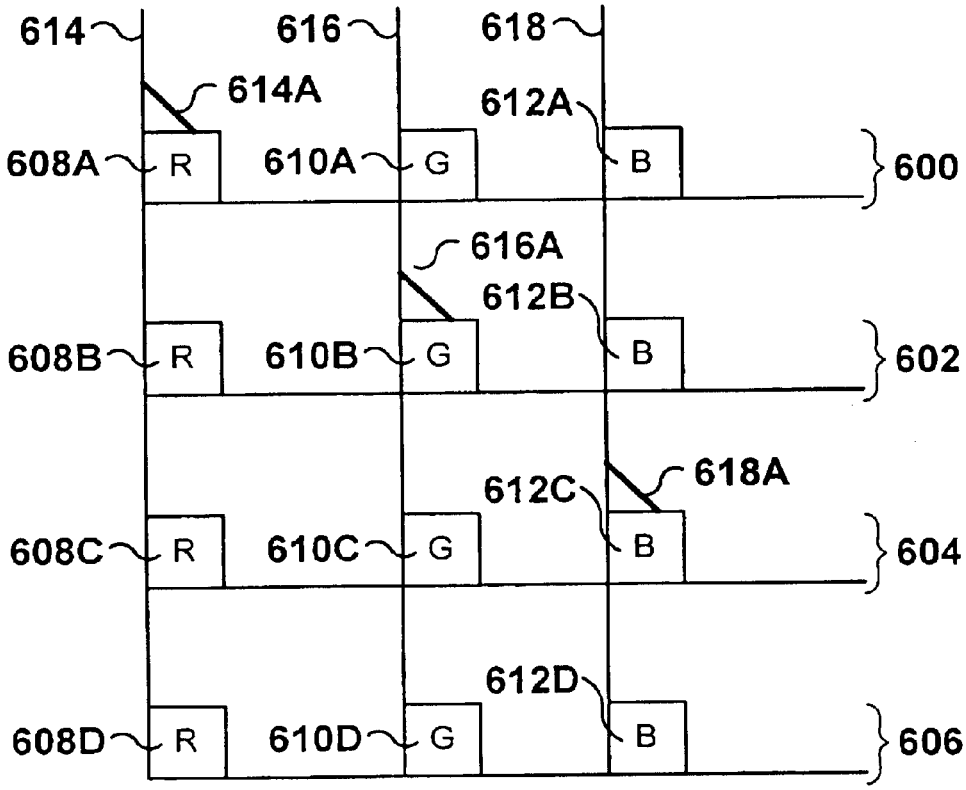
FIG. 6 illustrates a configuration of strobe lines connected to display circuits.

FIG. 6 illustrates an embodiment where the total number of strobe lines in the display system is reduced from a 1:1 strobe line to memory cell ratio by increasing the number of memory cells connected to individual strobe lines. In particular, FIG. 6 illustrates an embodiment where each strobe line corresponding to a color and is connected to a plurality of cells of the respective color so that each STROBE signal controls a plurality of cells of the respective color. The figure depicts four display circuits 600, 602, 604, 606 with three SRAM cells per display circuit. Each display circuit 600 has a RED CELL 608, a GREEN CELL 610, and a BLUE CELL 612. The four RED CELLS (608A–D) are connected to a single RED STROBE 614 by connection 614A the four GREEN CELLS (610A–D) are connected to one GREEN STROBE 616 by connection 616A, and the four BLUE CELLS (612A–D) are connected to one BLUE STROBE 618 by connection 618A. When the RED STROBE signal is activated, the voltages stored in the four RED CELLS connected to the RED STROBE are transferred to their respective pixels. The GREEN STROBE and BLUE STROBE signals operate analogously.

As can be seen from FIG. 6, it is possible to reduce the number of strobe lines in a display system from a 1:1 strobe line to memory cell ratio by having multiple memory cells be controlled by a single strobe line. It should be understood that depending on the application, it may be desirable to increase the number of strobe lines in order to minimize power consumption at the expense of display thickness or decrease the number of strobe lines in order to reduce the thickness of the display at the expense of power consumption.

The display matrix of the present invention can be designed to be employed in a wide variety of electronic devices in which a real or virtual image needs to be displayed. In particular, the display matrix is intended for use in small sized electronic devices such as portable computers, personal communicators, personal digital assistants, modems, pagers, video and camera viewfinders, mobile phones, television monitors and other hand held devices.

In one particular embodiment, the display matrix is employed in a virtual image display system where the display matrix forms a source object which is then magnified by one or more magnification optics. In this embodiment, the display matrix is preferably sized to be a microdisplay.

Figure 7A:
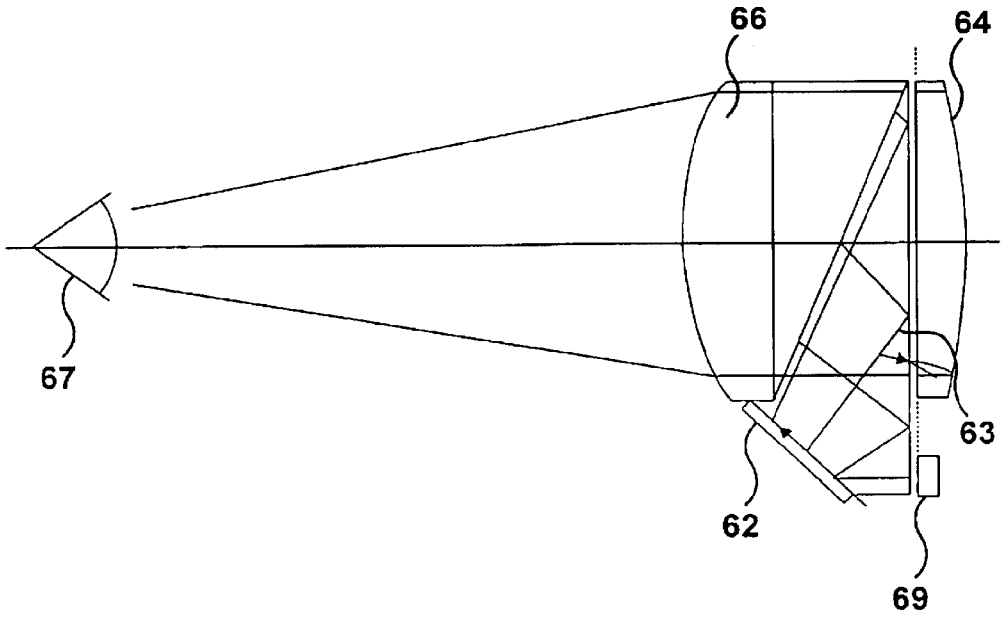
FIG. 7A illustrates a virtual image display system which includes a display matrix which projects an image onto a back surface of the first magnification optic which reflects (at least partially by total internal reflection) the image to a surface having a magnification function and a reflection function.
Figure 7B:
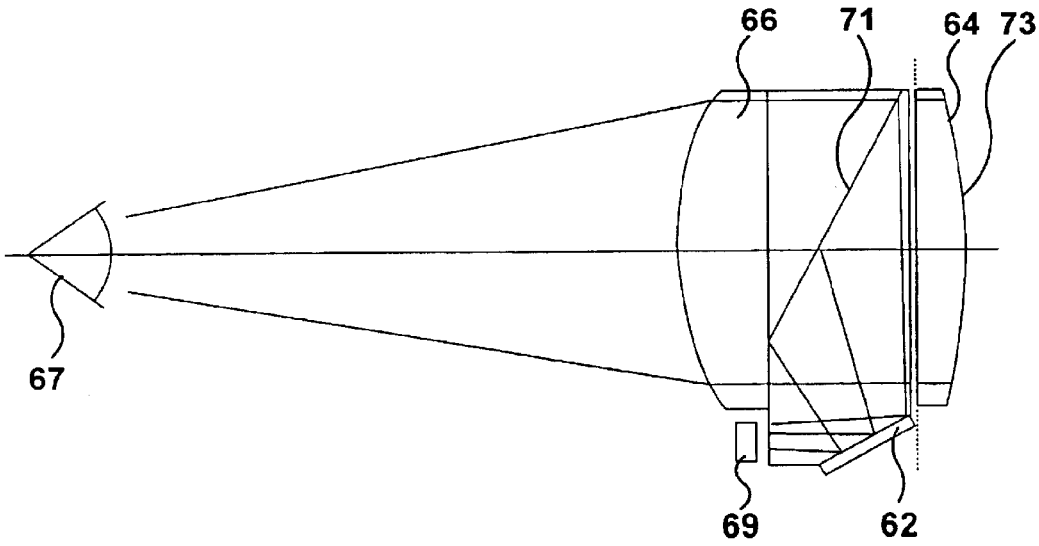
FIG. 7B illustrates a virtual image display system which includes an illumination source which reflects light off the microdisplay system to a beamsplitter which reflects an image formed by the microdisplay to a surface of the first magnification optic having a magnification function and a reflection function.
Figure 7C:
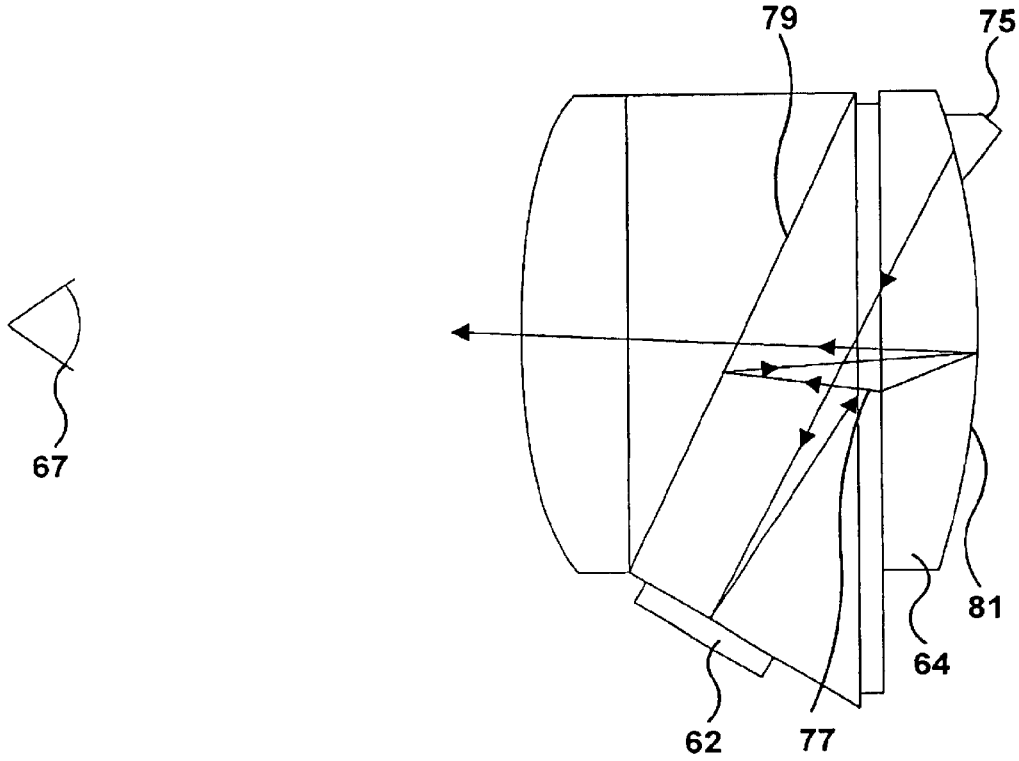
FIG. 7C illustrates a virtual image display system which includes an illumination source which reflects light off the microdisplay system to a back surface of a first magnification optic which reflects the light to a beamsplitter which reflects the light to a surface of the first magnification optic having a magnification function and a reflection function.

FIGS. 7A–7C illustrate three examples of a virtual image display which include a display matrix according to the present invention, and one or more magnification optics.

FIG. 7A illustrates a virtual image display system which includes a display matrix 62 which projects an image onto a back surface 63 of the first magnification optic 64 which reflects (at least partially by total internal reflection) the image to a surface 65 having a magnification function and a reflection function. The surface 65 reflects the image to a second magnification optic 66 and to an observer 67.

FIG. 7B illustrates a virtual image display system which includes an illumination source 69 reflects light off the microdisplay system 62 to a beamsplitter 71 which reflects an image formed by the microdisplay to a surface 73 of the first magnification optic 64 having a magnification function and a reflection function. The surface 73 reflects the image through the beamsplitter 71 to a second magnification optic 66 and to an observer 67.

FIG. 7C illustrates a virtual image display system which includes an illumination source 75 which reflects light off the microdisplay system 62 to a back surface 77 of a first magnification optic 64 which reflects the light to a beamsplitter 79 which reflects the light to a surface 81 of the first magnification optic 64 having a magnification function and a reflection function. The surface 81 reflects the light through the beamsplitter 79 to a second magnification optic 66 and to an observer 67. Examples of virtual image display systems which can be used include but are not limited to the virtual image display systems described in U.S. Pat. Nos.: 5,625,372; 5,644,323; and 5,684,497 which are each incorporated herein in their entirety by reference.

Figure 8A:
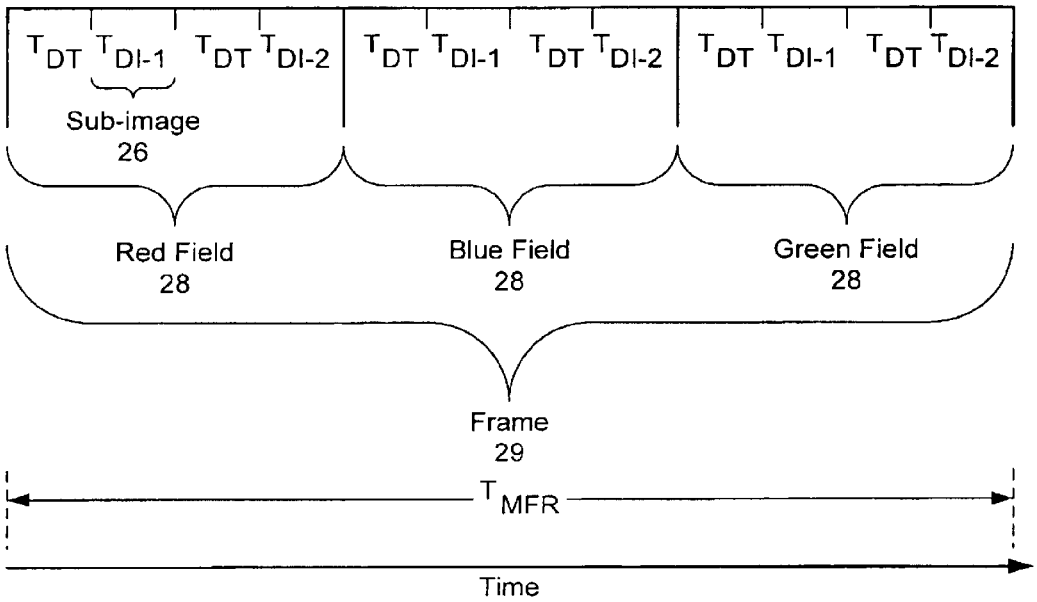
FIG. 8A illustrates the data transfer and display sequence of a prior art display matrix which employs a single memory cell per pixel.
Figure 8B:
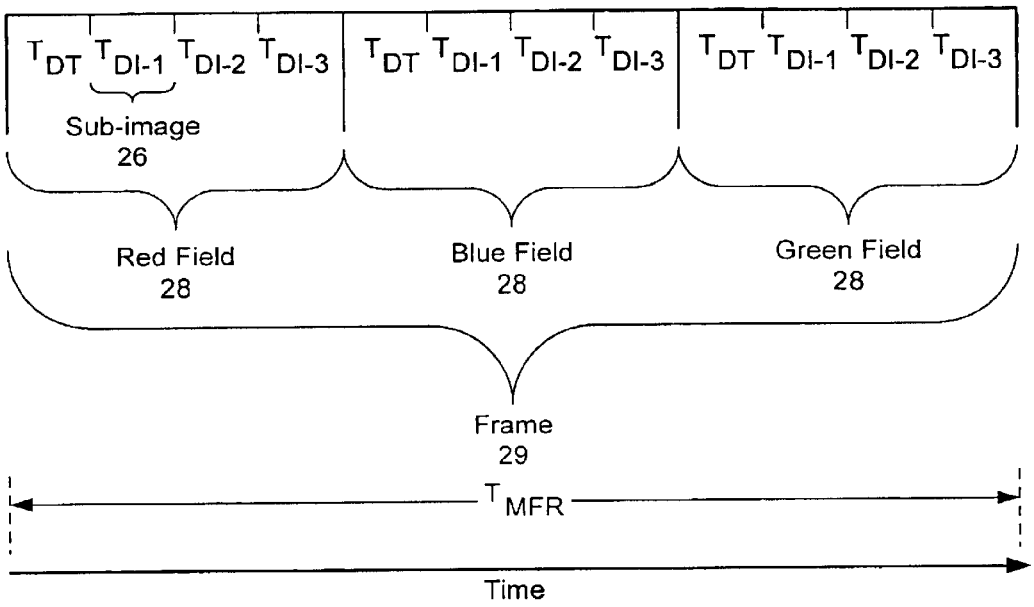
FIGS. 8B and 8C illustrate data transfer and display sequences that may be used when a display matrix according to the present invention which employs two or more memory cells per pixel is operated in an FSC mode.

One feature of the present invention is the efficiency with which the display matrices of the present invention may be operated in a field sequential color (FSC) mode. In a typical FSC mode, a composite image is formed through the repetition of a sequence of different color sub-images, typically red, green, and blue sub-images. As illustrated in FIGS. 8A and 8B, the one or more sub-images 26 corresponding to a color is called a field 28. A single sequence of the different fields is called a frame 29.

Sub-image data generally differs by field 28 in an FSC system. In the special case where the data is identical across the red, green, and blue fields, the composite image appears monochrome with gray levels.

Data transfer requirements for an FSC mode are more stringent than for a general system for sequentially formed composite images. The total length of time that a sub-image may be displayed, from the end of the display of the prior sub-image to the end of the display of the current sub-image, is limited by the minimum frame rate necessary to avoid flicker. The data for a particular sub-image must also be present in the display matrix from the beginning to the end of the sub-image. The quality of the image produced is reduced if part of the one color frame is displayed while a part of another color frame is displayed.

FIG. 8A illustrates the data transfer and display sequence of a prior art display matrix which employs a single memory cell per pixel. As illustrated, the entire data transfer for a sub-image takes place during a time period $T_{DT}$ after the time period for displaying the prior sub-image $T_{DI-1}$ and before the time period for displaying the current sub-image, also $T_{DI-2}$. In order to avoid flicker, the period of time available for data transfer and display is limited by the minimum frame rate $T_{MFR}$. The need to transfer the entire data for a sub-image during the time period $T_{DT}$ which is less than the minimum frame rate $T_{MFR}$ time period creates a high instantaneous bandwidth requirement on a prior art display matrix operating in an FSC mode. The average bandwidth requirement, which is a direct function of the frame rate as well, is accordingly high.

Figure 8C:
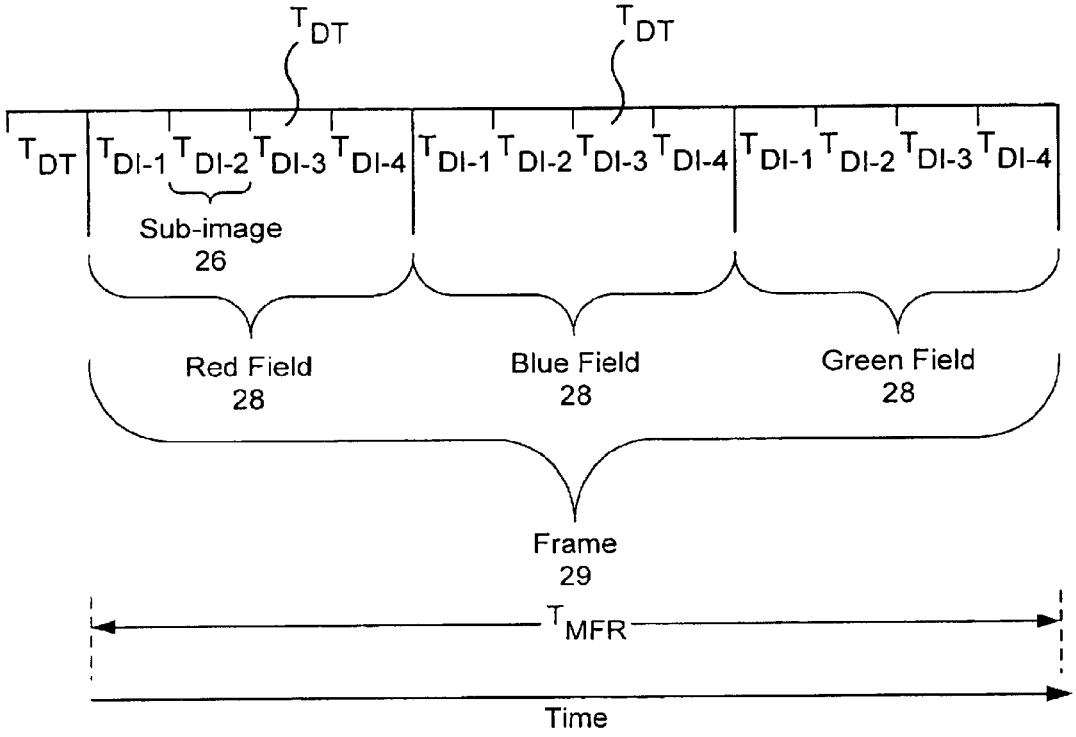

FIGS. 8B and 8C illustrate data transfer and display sequences that may be used when a display matrix according to the present invention which employs two or more memory cells per pixel is operated in an FSC mode. When a display matrix employs two or more memory cells per pixel, it is possible to store data for more than one sub-image, whether of the same or a different field. In one embodiment, the display matrix includes sufficient data to store all of the individual sub-images of a field or the entire composite image simultaneously.

As illustrated in FIG. 8B, by having sufficient memory to store multiple sub-images, it is possible to display multiple sub-images of a field, optionally all the sub-images of a field, without having to transfer any data into memory. Alternatively, as illustrated in FIG. 8C, by having sufficient memory to store multiple sub-images, it is possible to display one sub-image while transferring data for another sub-image into memory. As discussed herein, the ability to display one sub-image while transferring data for another sub-image into memory enables one to produce more colors and other visual effects than would otherwise be possible due to the greater instantaneous bandwidth requirement of prior art display matrices operated in an FSC mode.

As demonstrated by the data transfer and display sequences illustrated in FIGS. 8B and 8C, the use of two or more memory cells per pixel in a display matrix significantly reduces the instantaneous bandwidth requirement of the system. In addition, in the case where the data for one particular field sub-image is the same as the that for the next sub-image of the same field, the data for the next sub-image does not need to be transferred at all, reducing the average bandwidth requirement.

The present invention is intended to encompass display matrices where each memory cell consists of one bit or more than one bit of memory. As used herein, a digital display system refers to a display system where a single binary bit of memory is associated with each memory cell. In this system, the selector outputs a binary value as a function of the data stored in the memory cells, and binary control signals are provided to each display circuit. By binary is meant a two-level voltage system, where each voltage can be represented by either a 0 or a 1.

In a digital display system, gray levels within a particular color field may be attained by multiplexing different sub-images of that field. By showing certain sub-images of a field longer than other sub-images, certain sub-images are rendered more significant to the composite field image than other sub-images. For instance, in a display matrix with two memory cells per display circuit, the first memory cell in each display circuit may correspond to the most significant bit (MSB) of the binary representation of the grayscale values for a particular field. The second memory cell in each display circuit may correspond to the least significant bit (LSB). In a display matrix with three memory cells per display circuit, the first memory cell may be the most significant bit (MSB), the second memory cell the second significant bit (SSB), and the third memory cell the least significant bit (LSB).

Figure 9A:
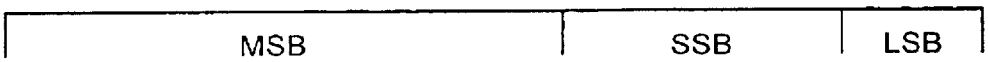
FIG. 9A illustrates a time line for displaying one bit plane for a larger portion of the time that a particular frame is displayed by displaying that bit plane longer than other bit planes.
Figure 9B:
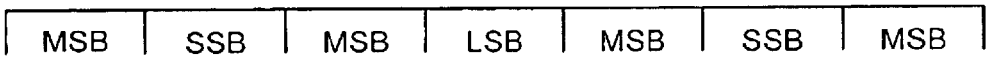
FIG. 9B illustrates a time line for displaying one bit plane for a larger portion of the time that a particular frame is displayed by displaying that bit plane more frequently than other bit planes.

By displaying each bit for different portions of the time that a particular frame is displayed, a multiple grayscale field may be formed. One bit may be displayed for a larger portion of the time that a particular frame is displayed either by displaying that bit longer, as illustrated in FIG. 9A, or by displaying that bit more frequently, as illustrated in FIG. 9B. For example, a four-level grayscale system is achieved in a two bit system when the MSB sub-image is displayed for twice as long as the LSB sub-image. The total display time for both sub-images equals the display time for the field.

Generalizing the concept of temporally multiplexing binary sub-images, the number of gray levels possible is equal to $2^N$, when N is the number of sub-images. One particular sub-image corresponds to the MSB of the binary representation of the gray level; another to the LSB. Sub-images corresponding to the $2^{nd}$ ($2^{nd}$ SB), $3^{rd}$ ($3^{rd}$ SB), and further significant bits of the binary representation are possible for systems of more than two sub-images. The total duration of one sub-image is proportional to $1/2^M$, where M is the significance of the bit corresponding to the sub-image. The total duration for one sub-image may be continuous or broken into smaller time slices for interleaving with other sub-images.

The total number of perceived colors possible in a system is the product of the number of gray levels for each constituent color field. For example, 64 colors may be generated by a three color system where each color has a four degree gray level (4×4×4).

In one embodiment of the present invention, two memory cells are present in each display circuit. Once data has been loaded into the display matrix, it is possible to form either a dichromic composite static image or a four-level grayscale monochromic composite static image. In the dichromic case, one memory cell of each display circuit contains the data corresponding to one color field and to the location of the display circuit within the image. The second memory cell contains the corresponding data for the second field. By cycling between the two sub-images corresponding to the memory cells within each display element, a dichromic composite static image is formed.

In the four-level grayscale case, the memory cells of each display circuit contain the MSB and LSB of the image data associated with a single color field. By cycling between the two corresponding sub-images, while keeping the total duration of the MSB image twice that of the LSB image, four levels of grayscale are achievable.

It is noted that in both the dichromic and four-level grayscale cases, if the image is static, there is no need to load data into memory more than once. A display system of the present invention just continues cycling between the two sub-images to achieve the intended effect. Data is only reloaded when the image content changes. In contrast, in a prior art display system with only a single binary memory element in each display circuit, data would have to be loaded in with every sub-image, for both the dichromic and four-level grayscale cases, regardless of whether the image content had changed. Even if the sole memory element were analog, data would still have to be loaded in with every sub-image for the dichromic case.

In analogy with the two cell case, with three memory cells present in the display circuit, a three-color composite image and an eight-level grayscale monochromic composite image are possible with data reloading not necessary until the image content changes. With four memory cells, three basic cases are possible: (1) a four-color composite image; (2) a dichromic composite image with four levels of grayscale in each color; and (3) a 16-level grayscale monochromic composite image.

In analyzing display circuits with more than four memory cells, many permutations of numbers of color fields and grayscale levels are possible and are all intended to fall within the scope of the present invention. If the analysis is confined to typical display systems operating in an FSC mode with three fields, some of the interesting display circuits are those with (1) six memory cells for four levels of grayscale per field; (2) nine memory cells for eight levels of grayscale per field; (3) twelve memory cells for 16 levels of grayscale per field; and (4) eighteen memory cells for 64 levels of grayscale per field.

In general, each memory cell in a display circuit of the present invention corresponds to a sub-image. The sub-images corresponding to different memory cells are output from the display matrix according to the control signals provided to each display circuit. The sub-images can have any order and may be displayed for any amount of time. For example, a particular sub-image may be displayed more frequently than other sub-images, as in the case of the MSB sub-image. The sub-image may also be displayed for a longer period of time than other sub-images.

The assignment of sub-images to different memory cells may be dynamic. In a system with three bits of memory for display element, the assignment of the first, second, and third memory cells as the MSB, SSB, or LSB can be changed, field to field and/or frame to frame. For example, the first memory cell of every display element may at one time be assigned to the MSB sub-image of the red field and at another time to the LSB sub-image of the green field.

In display systems for sequentially formed composite images, the display image data is transferred to the display matrix from a frame buffer. The frame buffer is typically external to the display system in the sense that the frame buffer is a separate component from the display matrix.

The purpose of an external frame buffer is to house an entire frame of data and act as an intermediary between some sort of processor, which initializes and modifies the image in the frame buffer, and the display matrix, which displays the image or part thereof The data transfer bandwidth between the processor and the frame buffer varies according to the rate of change in the content of the image. For example, a static, monochromic image requires essentially zero bandwidth. a display system operating in an FSC mode with a high frame rate, the bandwidth requirement remains high regardless of how static the image may be.

A display matrix of the present invention can also be used to store multiple sub-images, for example all the sub-images of a single color field as opposed to an entire frame. For example, with three memory cells in each display element, the memory cells can be assigned to the MSB, SSB, and LSB sub-images of a color field, for a total number of $2^3$=8 shades of gray. If the memory cells are then reassigned to corresponding sub-images of the next color field during the display of the next color field, then 8 levels of grayscale will be possible for the next color field as well. For an entire frame, a total of $8^3$=512 colors are possible.

Using a display matrix of the present invention operated in an FSC mode, it is possible to house an entire frame of data in the display matrix itself. For example, a three color FSC system may be built from a display matrix having three memory cells in each display element. Each memory cell would be dedicated to a different color field sub-image. Since there would only be one bit per field, the total number of colors possible in the system would be $2^3$=8. With six memory cells in each display element, $4^3$=64 colors would be possible.

The advantage of housing an entire frame of data within the display matrix is that the external frame buffer may be completely eliminated from the display system, saving not only a component but also a great deal of bandwidth. Only the bandwidth between the processor and the display matrix would remain. In contrast, operating a prior art display matrix in FSC mode, there is no room within the display matrix to house multiple sub-images simultaneously, necessitating an external frame buffer.

One condition for eliminating the external frame buffer is that the display matrix behave like an external frame buffer from the processor point of view. In particular, the display matrix should behave like a memory: random access addressable as well as readable and writable. In contrast, the display matrix of prior art typically is not random access addressable and is only writable.

The primary interface to the display matrix from the source of image data can mimic that of a synchronous SRAM. For example, the clocked interface includes a general backplane IC chip select and a read/write signal. An internal write buffer supports consecutive writes to the memory cells in the display matrix and to programmable registers outside the display matrix. The latency to the first read data from either the memory cells or the programmable registers is a fixed number of cycles. Data on consecutive cycles is returned on burst reads. The length of burst accesses can be programmed to be 1, 2, 4, or 8 words, where the length of a word is defined as the data bus width. The latter is initialized to 8 bits on reset, but can be reprogrammed to 8, 16, or 32 bits. A total of 20 address lines can be used to specify the destination of a read or write to the memory matrix.

A secondary interface optimized for minimum pin count is also possible. The secondary interface can include a vertical synchronization signal, a horizontal synchronization signal, a data enable signal, and a clock, along with 8, 16, 24, 32, or some other intermediate number of bits of data. The secondary interface can be used to scan data into the display matrix only, with no capability to read data from the matrix.

A variety of actual sources of image data outside the display matrix may be used. For instance, read only memory (ROM), programmable memory such as a field programmable gate array (FPGA), an external frame buffer, or a processor are possible.

Layout Designs for Display Circuits

An aspect of the present invention relates to layout designs for positioning a plurality of display circuits adjacent pixels of a corresponding display element. For instance, in a display system of the present invention, there are multiple memory elements per pixel. As the number of memory elements per pixel increases, it becomes increasingly difficult to position the display circuit including the plurality of memory elements adjacent the pixel. It is thus necessary to design the layout of the display matrix to accommodate for display circuits which do not fit within the spatial confine, or "footprint", of the corresponding pixel.

One aspect of the present invention relates to a display matrix layout design where the display circuit is at least partially positioned outside of the footprint of the pixel. Another aspect of the present invention relates to a display matrix layout design where a display circuit is positioned within the footprint of two or more pixels. Yet another aspect of the present invention relates to a display matrix layout design where two or more display circuits are positioned within the footprint of a pixel. These layout designs allow multiple memory cells to be positioned more closely adjacent each pixel.

Figure 10:
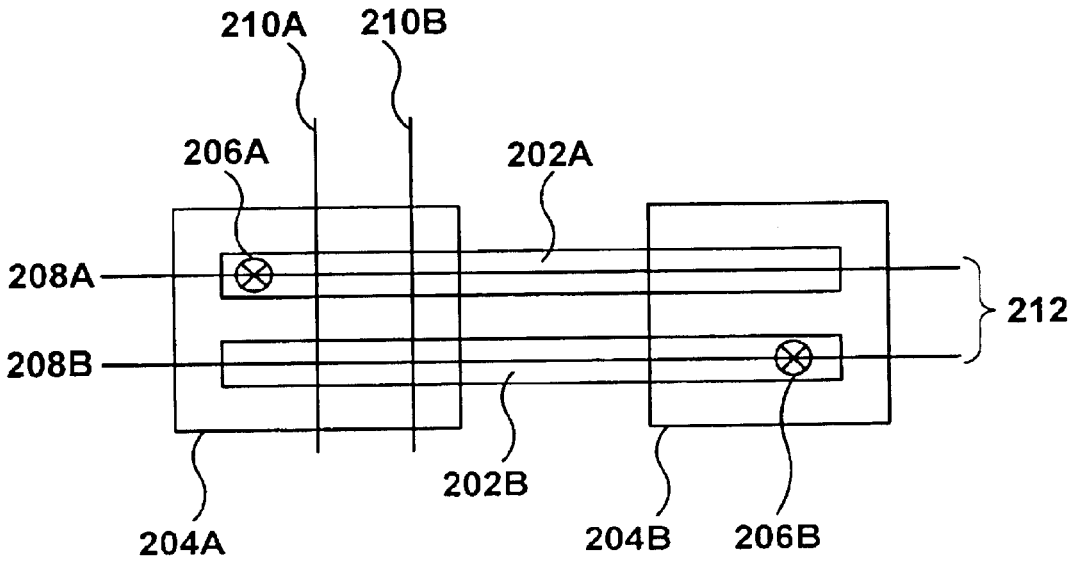
FIG. 10 illustrates a pair of display circuits and a pair of pixels, wherein the display circuits are partially within the footprints of each of the pixels, and the pixels are partially within the footprints of each of the display circuits.

The layout designs described above are illustrated in FIGS. 10–12. FIG. 10 illustrates two rectangular display circuits 202A, 202B placed under two pixels 204A, 204B. Each display circuit is at least partially located within the footprints of both pixels. Additionally, each pixel is placed within the footprints of both display circuits. However, each of the display circuits has an electrical connection to only one of the pixels 206A, 206B, thereby preserving the correspondence of one pixel to one display circuit in each display element.

Figure 11:
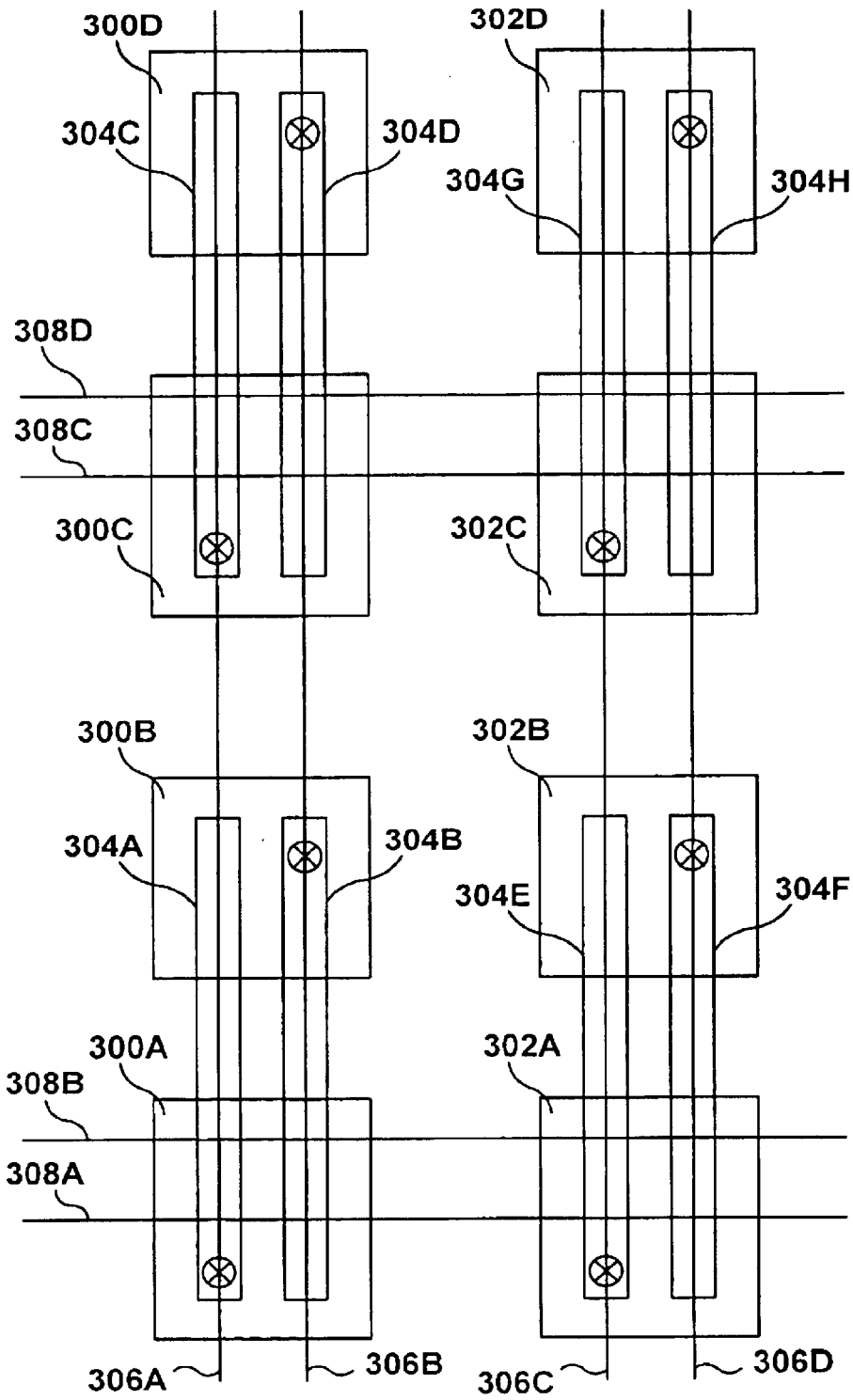
FIG. 11 illustrates a matrix of display circuits and pixels, wherein multiple data circuits overlap the footprints of multiple pixels, and data lines are connected to multiple display circuits.
Figure 12:
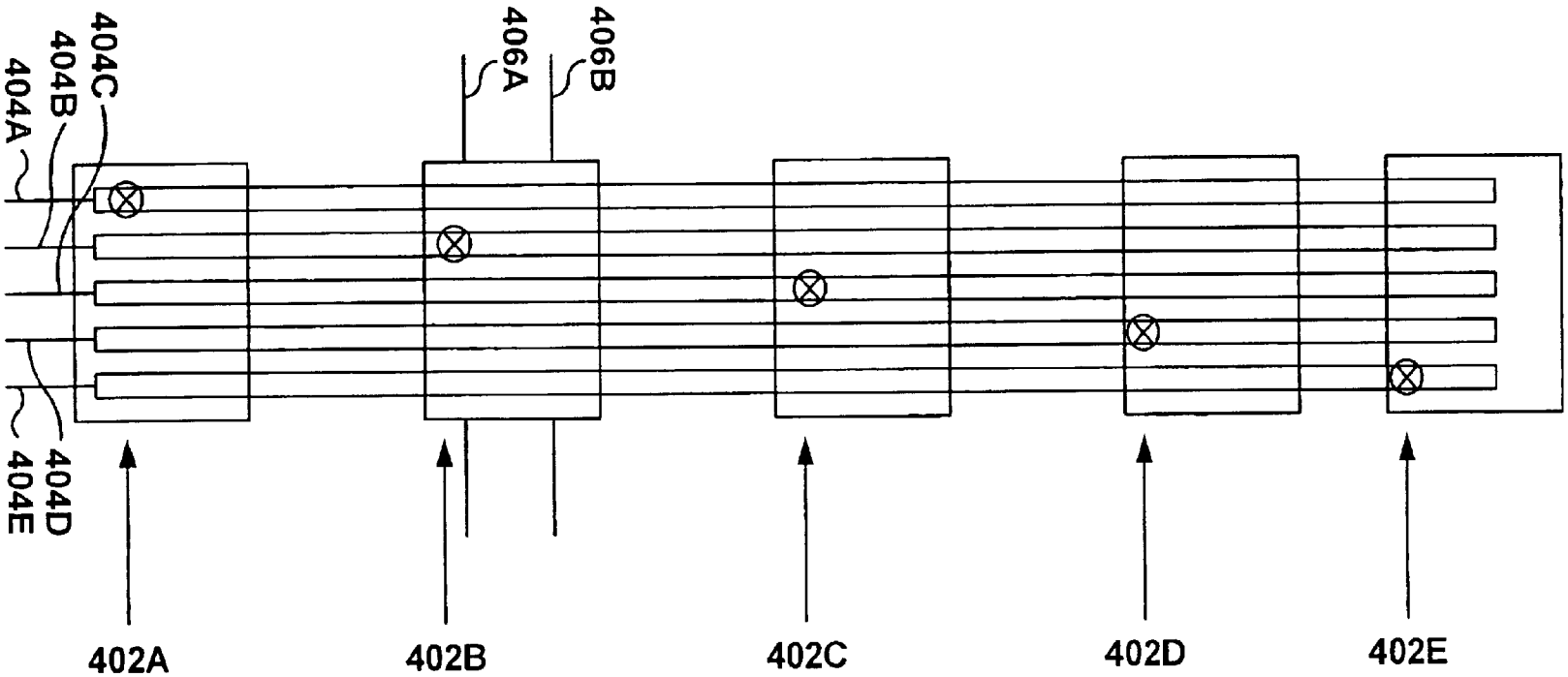
FIG. 12 illustrates five display circuits, each of which is partially within the footprint of each of five pixels, wherein a single set of data lines is connected to all five data circuits.

One feature of the layout designs illustrated in FIGS. 10–12 is the positioning of multiple address lines under each pixel or under each row of pixels. In order to facilitate random access to the memory elements of each display circuit, each of the display circuits must be separately addressable. This requires each display circuit to be connected to an address line. When two or more display circuits are placed in the footprint of a pixel, the same number of address lines are placed under the pixel, one for each display circuit.

The positioning of multiple address lines under each pixel and under a row of pixels is illustrated in FIG. 10. Each of the display circuits 202A and 202B is connected to a single address line, 208A and 208B, respectively. But since both display circuits lie within the footprint of one pixel 204A, there are two address lines running under one row of pixels 212 in the display matrix.

The layout illustrated in FIGS. 10–12 were multiple display circuits are positioned within the footprint of a pixel provides a further advantage of enabling a substantial decrease in the number of data lines (e.g., bit and bit bar lines) used in the display system. By placing multiple display circuits within the footprint of an individual pixel, multiple data circuits can be connected to a single pair of bit and bit bar lines. The layout also results in an increase in the number of address lines that are used in the display system in order to preserve random access to the memory elements in the display system. However, the reduction in the number of data lines is more significant.

Each display circuit in the display matrix connects to a BIT line and a BIT BAR line. By placing multiple display circuits within the footprint of each pixel, each display circuit within the footprint of a pixel can be connected to the same BIT and BIT BAR lines. This allows for a net reduction in the number of BIT and BIT BAR lines connected entering the display system.

How the number of data lines can be reduced according to the present invention will now be illustrated with regard to FIGS. 10–12. In FIG. 10, display circuits 208A, 208B are both located under pixel 204A and pixel 204B. An address line is provided for each display circuit, shown in the figure as address lines 208A, 208B. Meanwhile, a single pair of data lines (BIT 210A and BIT BAR 210B) are used for both display circuits. As a result, only 4 data and address lines are employed. By contrast to FIG. 10, one could use a single address line for both display circuits and two data lines for each display circuit (not shown). This, however, would result in 5 data and address lines being used.

FIG. 11 illustrates another embodiment where there are two rows and four columns of pixels (300A, 300B, 300C, 300D and 302A, 302B, 302C, 302D). Each row of pixels is divided into two pairs with a pair of display circuits (304A–H) being positioned underneath the pair of pixels, as in FIG. 10. Two address lines (306A–D) are positioned under each row of pixels and a pair of data lines (308A–D) are provided for each two columns of pixels. As illustrated in FIG. 11, a total of 8 data and address lines are employed.

By contrast, if BIT and BIT BAR lines were used for each column of pixels, and an address line were used for each row of pixels, 10 data and address lines would be employed.

FIG. 12 illustrates yet another embodiment where there are five display circuits (402A–E) and five address lines (404A–E) running under the display circuits. Meanwhile, a single set of data lines (406A–B) are used for the five display circuits. As can be seen, only 7 data and address lines are used. By contrast, if one were to use 1 address line and 5 it would be connected to 3 pairs of data lines, one pair per memory cell. Since there are 800 columns, there would need to be 4800 data lines. Combined, a total of 5400 lines are needed.

Now lets assume one lays out a display matrix consisting of 600 rows and 800 columns of pixels as illustrated in FIG. 11. Each row is connected to two address lines. For 600 rows there would be 1200 address lines. Meanwhile, only three pairs of data lines are used for every two columns. For 800 columns there would be 2400 data lines. Combined, a total of 3600 lines are needed.

In another example, suppose a display matrix consists of 600 rows and 800 columns of pixels where each display circuit includes 5 memory cells. Assume each display circuit is positioned within the footprint of each pixel. According to this layout design, there would be 600 address lines (1 address line per row) and 8000 data lines (800 columns×2 lines per memory cell×5 memory cells) for a total of 8600 lines.

Now lets assume that one lays out a display matrix consisting of 600 rows and 800 columns of pixels as illustrated in FIG. 12. Each row is connected to five address lines so 600 rows would require 3000 address lines. Meanwhile, only five pairs of data lines are used for every five columns. For 800 columns there would be 1600 data lines (800 columns×10 lines per 5 columns). Combined, a total of 4600 lines are needed. As can be seen, the reduction in the number of data lines becomes quite significant as the number of memory cells per display circuit increases.

Local Decoding of Addresses

An aspect of the present invention relates to the use of local decoding of row addresses in the display system to reduce the number of address lines, or "word lines," in the display system. According to this layout technique, decoders are inserted at periodic intervals in the display matrix. These decoders are connected to surrounding display circuits, so that each decoder is connected to rows of the display matrix. Each decoder receives a word line, two sub-word lines, and an enable line. The sub-word lines supply two bits, a Most Significant Bit (MSB) and a Least Significant Bit (LSB) which provide an offset for selecting one of the rows connected to the decoder. This obviates the need to connect an address line to each of the rows connected to the decoder. The enable bit is used to minimize power consumption.

Figure 13:
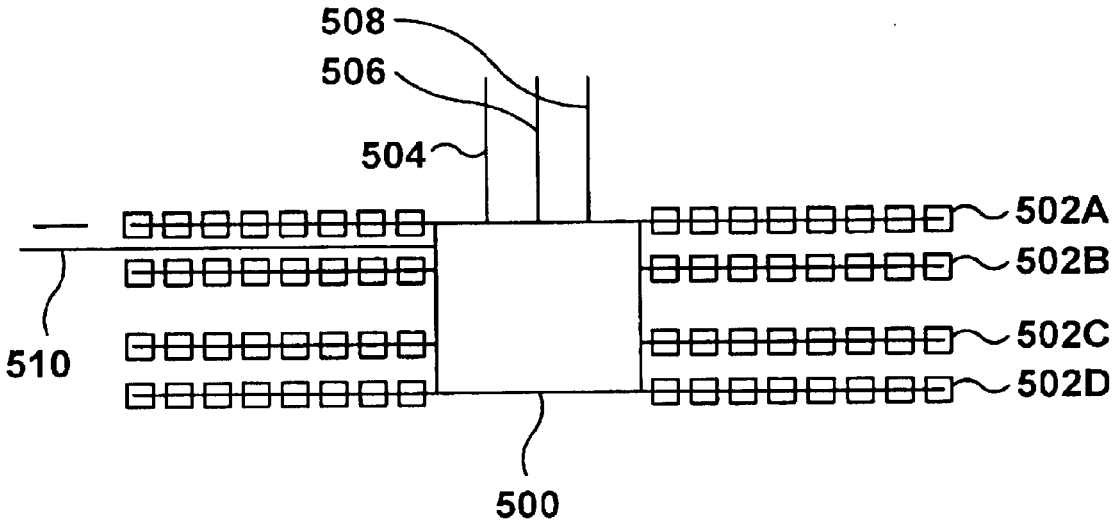
FIG. 13 illustrates a local decoder connected to four rows of data circuits.

FIG. 13 is a schematic illustration of local decoding. In this example, the local decoder 500 is connected to four rows of display circuits 502A, 502B, 502C, 502D in the display matrix. The rows of display circuits connected to the local decoder 500 are referred to herein as a cluster of display circuits. There are three lines entering the local decoder from above. Two of these are most significant bit MSB 504 and the least significant bit LSB 506, which decode which of the four rows connected to the decoder is being addressed. The third line entering the local decoder from above is an enable bit 504, intended to save power. The data lines serve as sub-address lines by controlling which display circuits are being operated by the local decoder.

The two data lines MSB and LSB provide an offset for selecting one of the rows connected to the decoder. Each value of the (MSB,LSB) pair connotes exactly one of the rows entering the decoder. For instance, "00" may denote the first row 502A, "01" the second row 502B, "10" the third row 502C, "11" the fourth row 502D.

The connection of the rows to the decoder, coupled with the offset provided to the local decoder, can be used to reduce the number of address lines connected to the rows of the display matrix. In particular, the number of address lines may be reduced by a factor equal to the number of values that can be denoted by the offset. To illustrate, consider FIG. 13. As there are four rows connected to the decoder, each of these four rows may be selected by one of the four values of the offset. Thus, to select one of these four rows, the display system needs only one word line connected to the decoder, and a pair of sub-word lines to select one of those four rows connected to the decoder. Thus, the number of address lines used in the display system can be reduced by a factor of four.

In the example of FIG. 13, the local decoders are placed after every 16 pixel columns. Thus, if there are 800 pixel columns in the display matrix, there are 800/16=50 decoders per row. As there are three lines entering each decoder, i.e., the sub-word lines MSB, LSB, and the enable bit, there are 50×3=150 additional lines entering the display matrix. However, if there are 600 rows, the number of address lines are reduced by a factor of four, to 150, resulting in 450 fewer address lines. Thus, the addition of the 150 offset and enable lines is countered by a decrease in 450 address lines.

The insertion of local decoders also confers benefits during fabrication of the display system, as it obviates the need to fabricate word lines in metal. The present embodiment eliminates the need for global word lines which span each row of display circuits, as global word lines are replaced with relatively short interconnects between decoders. The relative brevity of the interconnects allows them to be fabricated in poly-silicon rather than metal. The absence of metal word lines in the IC results in improved packing density, and frees space for other metal interconnects.

Reducing the Numbers of Word and Data Lines

The display circuit layout designs described above, for example with regard to FIGS. 10–12, can be combined with local decoding to produce a drastic reduction in the number of address and data lines entering the display matrix. As illustrated in regard to FIGS. 10–12, the number of data lines can be significantly reduced by connecting data lines to multiple data circuits. The resulting increase in address lines can then be diminished by replacing global word lines with local decoders.

The synthesis of these techniques can be illustrated by example. Consider a display matrix which consists of 600 rows by 800 columns and 3 memory elements per pixel. A display system with exactly one data circuit within the footprint of each pixel has 5400 total lines including 600 address lines and 4800 data lines [800×3 BIT lines and 800×3 BIT BAR lines]. By designing the display circuits so that two display circuits overlap each pixel (as in FIG. 11), the number of address lines is doubled to 1200, but the number of BIT and BIT BAR lines reduced to 2400, for a total of 3600 lines. If we then apply local decoding as shown in FIG. 13, the number of address lines is reduced by a factor of 4, reducing the number of address lines to 1200/4=300. Hence, by employing the layout and local decoding techniques described above, a grid of 600 address lines and 4800 data lines can be replaced by a grid of 300 address lines and 2400 data lines.

Modes of Operating The Display Matrix

Several different modes for operating a display matrix according to the present invention are possible. One mode, referred to herein as the "Power Miser Mode," relates to a mode where writing to the display matrix is minimized, there reducing the amount of energy consumed by the display matrix. Another mode of operation, referred to herein as the "Color Rich Mode," relates to a mode where data is written to memory cells forming one bit plane while memory cells of another bit plane are used to display an image in order increase the number of sub-images that can be used to form a composite image. By being able to increase the number of sub-images that can be used to form a composite image, a greater number of colors may be formed by the display matrix. Yet another mode of operation, referred to herein as the "Color Mixing Mode," involves operating a display matrix in a Power Miser Mode and Color Rich Mode at the same time.

While the Power Miser, Color Rich, and Color Mixing modes for operating a display matrix according to the present invention are provided below, it is noted that many additional modes of operating the display matrices can be employed.

1. Power Miser Mode

Figure 14:
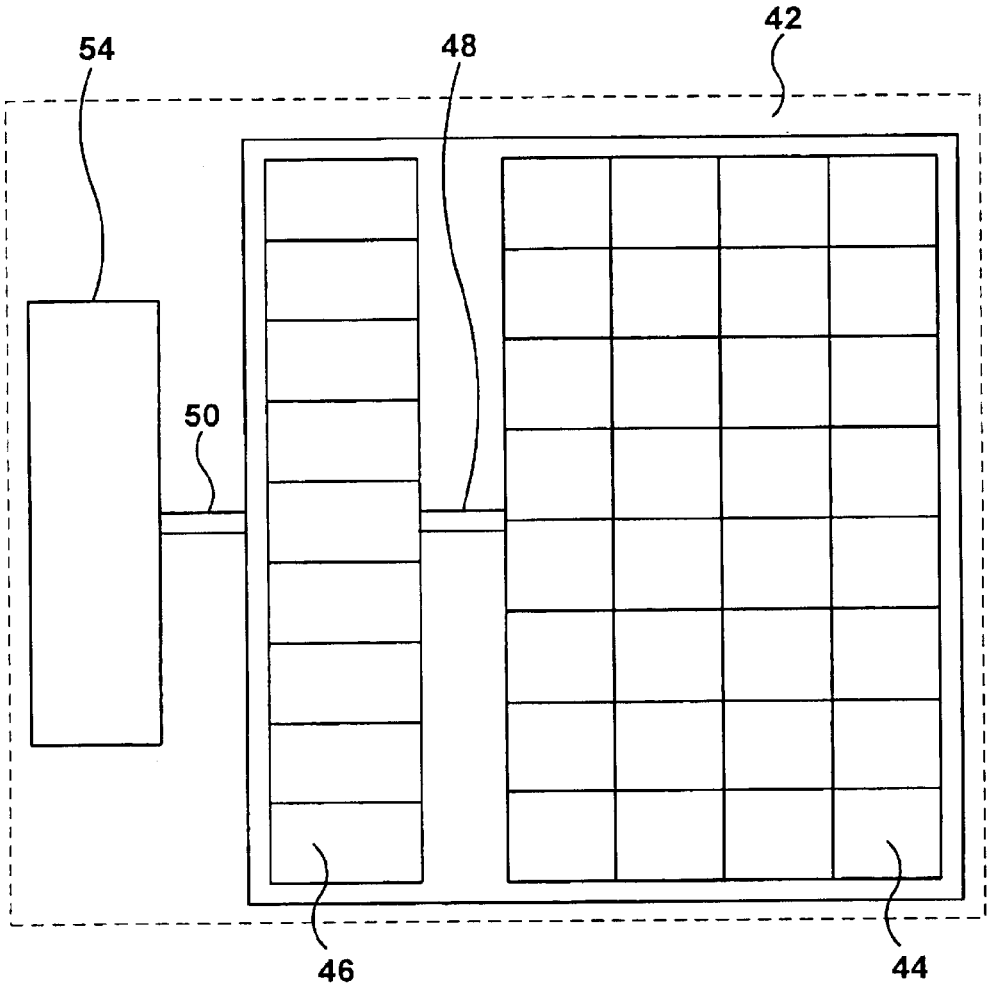
FIG. 14 illustrates a system in which a processor interfaces directly to the backplane IC.

One mode of operating a display matrix according to the present invention is illustrated in FIG. 14 in which a processor 54 interfaces directly with the display matrix (backplane IC) 42. This mode is referred to herein as power miser mode because the image is initialized and modified directly in the display matrix memory without the use and associated power consumption of an external frame buffer. Because the backplane IC is fundamentally digital in nature, component and power consumption costs associated with digital-to-analog converters or other analog circuitry is avoided.

In operation, the backplane IC offers several functions in support of power miser mode. The synchronous SRAM interface on the chip coincides with the memory model assumed by typical processors. By using three memory cells per display circuit, the chip also offers capacity for a red, a green, and a blue bit plane, the minimum necessary for a display matrix to operate in an FSC mode. The chip can also be programmed for FSC control, a sequence such as the following:

1. Turn off all illumination and select the red data plane with the RED STROBE.
2. After pausing for LCD alignment, turn on the red LED.
3. Turn off the red LED and select the green data plane with the GREEN STROBE.
4. After pausing for LCD alignment, turn on the green LED.
5. Turn off the green LED and select the blue data plane with the BLUE STROBE.
6. After pausing for LCD alignment, turn on the blue LED.

In an eight-level grayscale monochrome implementation of power miser mode, the RED, GREEN, and BLUE cells of each display circuit are filled with the MSB, SSB, and the LSB of the corresponding image data. The three bit planes can be strobed in a variety of time modulation schemes to achieve the eight levels of grayscale in the color of the single illumination source. One possibility is to strobe the bit planes in RMS fashion using distributed binary coding as described later.

An additional function unique to power miser mode is on-chip support for scrolling. Scrolling in the present invention consists of shifting a scroll region horizontally or vertically by a pixel. The contents of a scroll buffer are used to fill in the area vacated by the shift. The scroll region can be an entire bit plane or portion thereof.

Figure 15A:
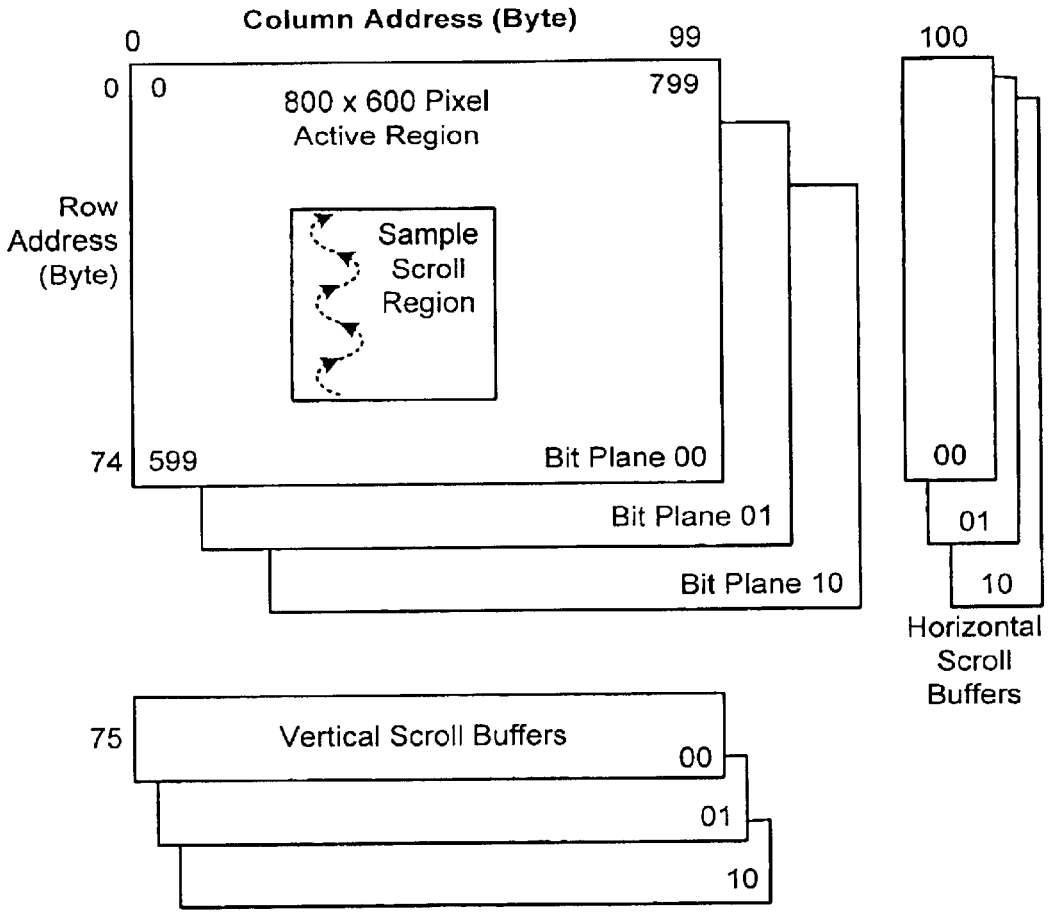
FIG. 15A illustrates an address map including scroll buffers.

FIG. 15A illustrates an address map including scroll buffers. The address bus illustrated in the figure is 20 bits wide. Bits $A_6$ through $A_0$ specify the column address of a byte, $A_{16}$ through $A_7$ its row address, and $A_{18}$ through $A_{17}$ its bit plane address. This address scheme assumes the three SRAM cells in each display element have been configured for separate address (WORD) signals. The address space of the display matrix encompasses 0–99 in the column address, 0–599 in the row address, and 0–2 in the bit plane address. Bit $A_{19}$ is the programming bit.

Buffers outside the active region are allocated for scrolling. The address space of a horizontal scroll buffer encompasses 100 in the column address and 0–599 in the row address. There are three horizontal scroll buffers, each differentiated by its bit plane address. The address space of a vertical scroll buffer encompasses 0–99 in the column address and 600–607 in the row address. There are three vertical scroll buffers, each differentiated by its bit plane address.

A scroll procedure may comprise the following steps:

1. The scroll buffer for a particular direction and bit plane is modified through processor reads and writes to its address space.
2. The scroll region programming registers are modified as necessary. The scroll command is issued by writing to the appropriate register. The backplane IC begins scrolling.
3. When scrolling is complete, the readyN pin is asserted back to the system so that another processor access can commence.

The scroll region is the area over which data will be shifted. The scroll region is defined by the coordinates of its upper left ($X_{UL}$, $Y_{UL}$) and lower right ($X_{LR}$, $Y_{LR}$) corners. The coordinates in the present invention are specified with byte granularity, so that the possible values are 0–99 in the X-direction and 0–74 in the Y-direction. Values greater than 99 in the X-direction and 74 in the Y-direction are prohibited. Data outside the scroll region will not be affected by the scrolling operation.

A second embodiment of scrolling is illustrated in FIG. 15B. A scroll region is first defined. In FIG. 15B the region is eight pixels high by eight pixels wide. However, it can be any region within the display matrix on a one-pixel boundary in the vertical direction and a two pixel-boundary in the horizontal direction.

The scrolling operation can move the contents of the scroll region up or down by one pixel or left or right by two pixels without affecting any of the data outside of the scroll region. Within the scrolling region, one row of pixels is always left unchanged by vertical scrolling and two columns of pixels by horizontal scrolling. These unchanged pixels must be overwritten by the new information from the external system to complete the scroll.

Scrolling is an example of hardware assistance for a graphical operation that is outside the operation of display matrices of prior art. By subsuming the external frame buffer within the display matrix of the present invention in power miser mode, a wide variety of hardware assistance functions for image modification become possible and useful within the display matrix.

2. Color Rich Mode

Figure 16:
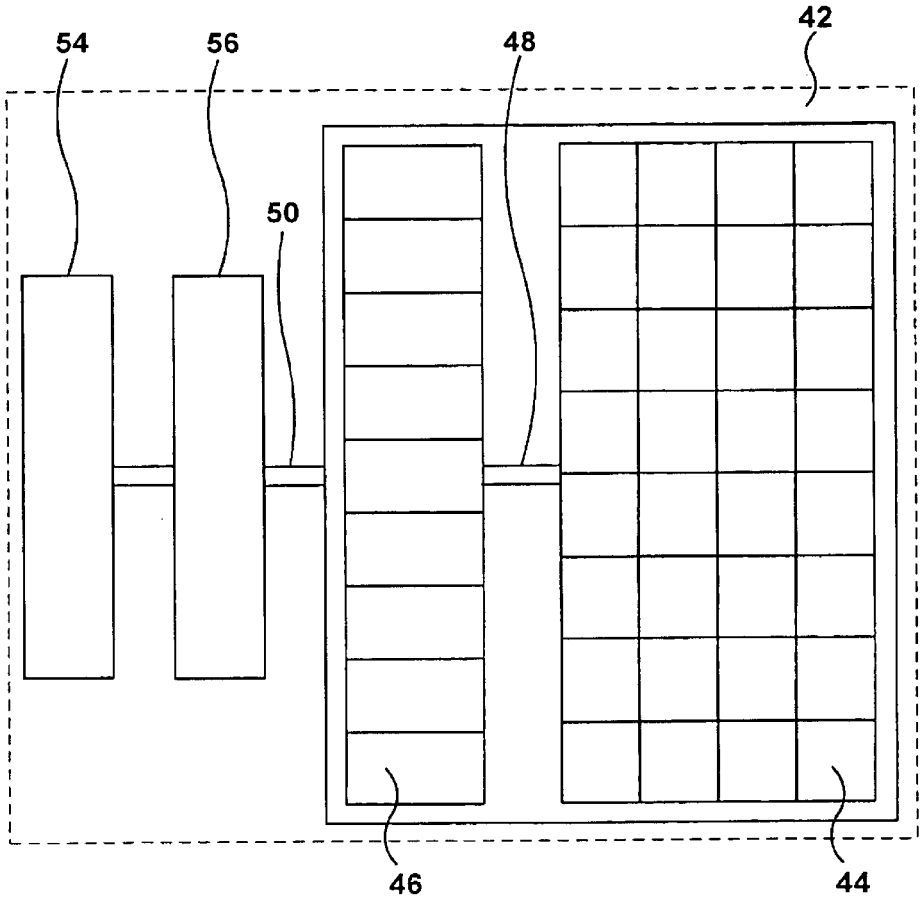
FIG. 16 illustrates a system in which an external frame buffer is placed between the processor and the backplane IC.

A second mode of operating a display matrix according to the present invention is illustrated in FIG. 16, in which an external frame buffer 56 is placed between the processor 54 and the display matrix (backplane IC) 42. This mode is referred to herein as color rich mode, because the multiple bit planes in the display matrix are used to generate multiple levels of grayscale in each of the color fields. For example, when three bit planes are used, eight levels of grayscale ($2^3$) are produced in each of three color fields for a total of 512 colors ($8^3$) in FSC operation.

An exemplary sequence for performing color rich mode in FSC operation is as follows:

1. Turn off all illumination.
2. Transfer the MSB, $2^{nd}$ SB, and LSB bit planes of the red image into the RED, GREEN, and BLUE memory planes of the display matrix.
3. Strobe the bit planes in RMS fashion using distributed binary coding as described below.
4. Turn on the RED LED.
5. Strobe the bit planes again in the same way.
6. Turn off the RED LED.
7. Transfer the MSB, $2^{nd}$ SB, and LSB bit planes of the green image into the BLUE, GREEN, and RED planes of the display matrix.
8. Strobe the bit planes.
9. Turn on the GREEN LED.
10. Strobe the bit planes.
11. Turn off the GREEN LED.
12. Transfer the MSB, $2^{nd}$ SB, and LSB bit planes of the blue image into the RED, GREEN, and BLUE planes of the display matrix.
13. Strobe the bit planes.
14. Turn on the BLUE LED.
15. Strobe the bit planes.

Figure 17:
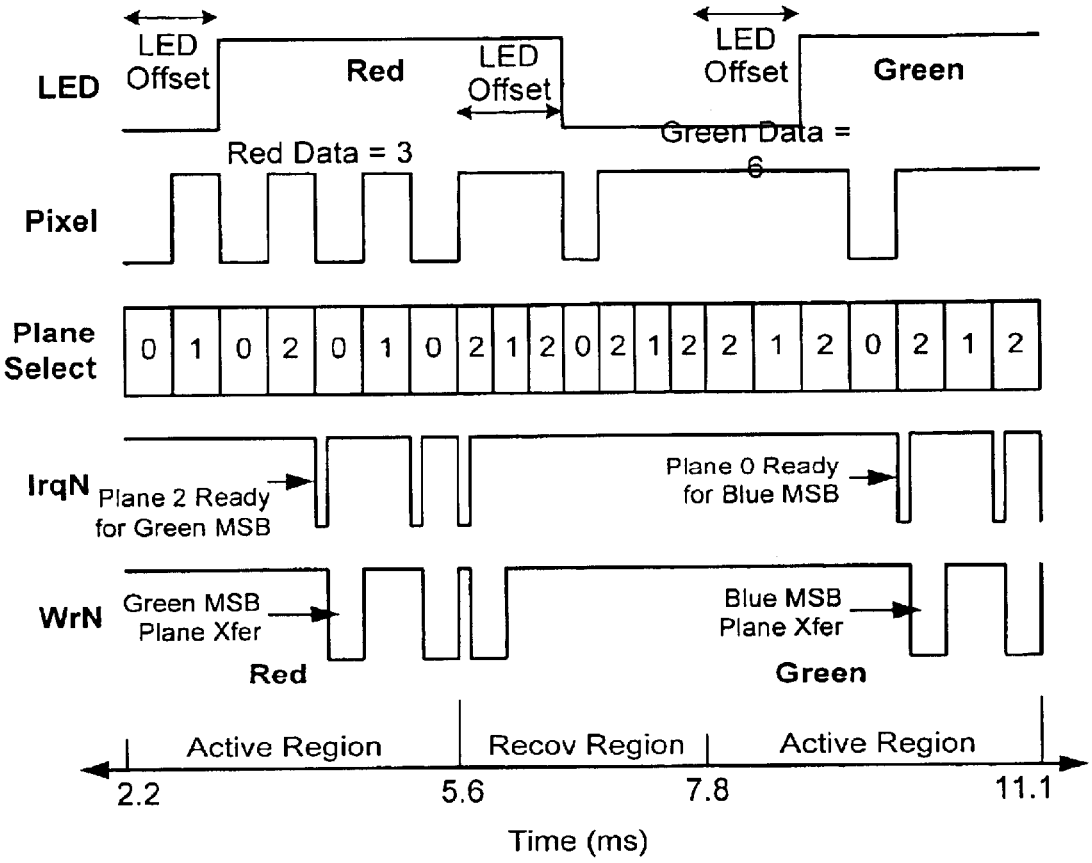
FIG. 17 illustrates part of a color rich mode sequence.

FIG. 17 illustrates part of the above sequence. The numbers 0, 1, and 2 are used to represent the RED, GREEN, and BLUE bit planes, respectively. Each color field in the figure has been divided into a RECOVERY and an ACTIVE period. The length of the ACTIVE period equals the length of time that the LEDs are turned on. A detail contained in the figure though omitted in the above sequence is that the turn on time for an LED may be delayed from the start of the ACTIVE period. The ACTIVE and RECOVERY periods may have different length. The sum of their lengths is determined by the length of a field, which is typically one-third the length of the frame. The strobing of the bit planes both before and after an LED is turned on in the above sequence corresponds to strobing in the RECOVERY and ACTIVE periods in the figure. It has been found through experiment, that during the RECOVERY period, strobing the correct value for the color field is better than driving a constant binary 1 or 0 on the pixel.

Gray levels in a particular color field are produced by multiplexing sub-images temporally at a very fast rate. In the terminology of color rich mode, the sub-images correspond to bit planes and multiplexing is the same as strobing. When the time for a particular LCD to relax or align in response to a new electric field is greater than the duration of a sub-image, Root Mean Squared (RMS) voltage techniques can be employed.

Various strobing algorithms are possible to achieve a certain gray level. For instance, in a 3 bit-plane system, a conventional coding scheme might divide up an interval, such as the RECOVERY or ACTIVE period, into seven equal parts, and assign the MSB plane to the first four parts, the SSB plane to the next two parts, and the LSB plane to the last part. Then a gray level 4 would be achieved by a 1111000 sequence, a 5 by a 1111001 sequence, etc.

Figure 18:
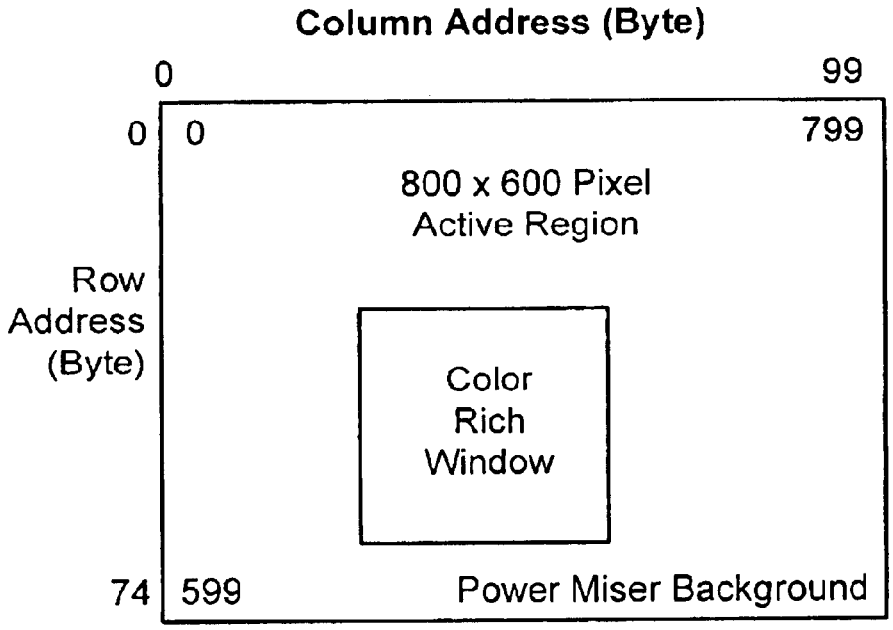
FIG. 18 illustrates a color mixing mode.

One algorithm that has been found empirically to have a better RMS effect than the above conventional coding scheme for a particular LCD is called distributed binary coding. A better RMS effect refers to the gradation in voltages driven on the liquid crystal being more uniform. The strobing formula for distributed binary coding is {MSB, SSB, MSB, LSB, MSB, SSB, MSB}. For example, 0={0000000}, 1={0001000}, 2={0100010}, 3={0101010}, 4={1010101}, 5={1011101},. 6={1110111}, and 7={1111111} . In FIG. 18, distributed binary coding is used to display a grayscale 3 in the red field followed by a 6 in the green field.

While the above formula relates to the present invention with three bit planes, distributed binary coding can be extended to display matrices of any number N of bit planes. The interval is first always divided into ($2^N-1$) time slots. The MSB plane time slots are determined first. The MSB plane is always placed in the first time slot and every other time slot there after. The $2^{nd}$ SB plane time slots is calculated next. The SSB plane is placed in the first available time slot and every fourth time slot thereafter. The $3^{rd}$ SB occupies the next available time slot and every eighth slot thereafter, and so on until the LSB ($N^{th}$) plane is place in the middle time slot. For instance, for four bit planes, the formula is {MSB, $2^{nd}$ SB, MSB, $3^{rd}$ SB, MSB, $2^{nd}$ SB, LSB, MSB, $3^{rd}$ SB, MSB, $2^{nd}$ SB, MSB}.

The ability of the display system of the present invention to perform distributed binary coding is a strong example of one of the advantages that the display circuit of the present invention provides. The grayscale level is strobed twice in one color field, once in the RECOVERY period and once in the ACTIVE period, for a total of 14 time slots. In a system with only one memory cell per display circuit, fourteen bit planes would have to be loaded in order to strobe during 14 different time slots. This would require a very high bandwidth transfer rate and pixel refresh rate. However, by using a display matrix capable of storing three different bit planes, different bit planes need not be continuously written into a display matrix. This allows strobing the transition between strobing different bit planes to be significantly reduced, thereby making it possible to have 14 time slots.

According to the present invention, it is possible to alternate the assignment of MSB memory matrices for consecutive color fields. This enables the display matrix to further take advantage of having more than one memory cell in each display circuit. For instance, in the above sequence, the {RED, GREEN, BLUE} memory matrices were assigned to {MSB, SSB, LSB} for the RED field, while in the ensuing GREEN field, the assignments were switched to {LSB, SSB, MSB}. This algorithm is driven by the nature of distributed binary coding, in which the LSB plane always falls in the middle time slot while the MSB plane is always at the beginning. Once the LSB plane for the ACTIVE period of the RED field has completed, the memory plane can be used for the first plane needed by the GREEN field, which is the MSB plane. Hence, by modifying the assignment of the bit planes as MSB, SSB and LSB, etc., it is possible to increase the number of bit planes which can be written to memory and strobed.

Distributed binary coding and the accompanying strategies discussed above have been found empirically preferable for certain liquid crystal formulations. Other algorithms may be better suited for other display matrices and are intended to fall within the scope of the present invention.

The backplane IC can include logic for performing a variety of algorithms. Such software control can also accommodate timing parameter changes which may be necessitated by temperature conditions or other factors.

Interrupts to the external frame buffer can also be provided to trigger the transfer of data to the next available memory plane.

3. Color Mixing

A third mode of operating a display matrix according to the present invention, referred to herein as color mixing, relates to the overlay of a color rich region on a power miser background. This mode of operation is illustrated in FIG. 18. By combining color rich operation with power miser operation, a window of high information content can be formed without incurring the bandwidth and power consumption costs associated with fall-screen color rich operation. The reduction in bandwidth requirements improves the compatibility of the display matrix with video applications. An example of a color mixing procedure that may be employed is as follows:

The window region configuration registers are modified as necessary.

The power miser mode is specified to be either 3 color fields at 1-bit/field or 3-bit monochrome, by writing to the appropriate configuration register as necessary.

Color rich windowing is enabled by writing to the appropriate configuration register.

The window region is the area over which data will be displayed in color rich mode. The area around the outside of the window region operates in power miser mode. The window region is defined by the coordinates of its upper left ($X_{UL}$, $Y_{UL}$) and lower right ($X_{LR}$, $Y_{LR}$) corners. The coordinates must be specified with byte granularity, so that the possible values are 0–99 in the X-direction and 0–74 in the Y-direction. Values greater than 99 in the X-direction and 74 in the Y-direction are prohibited.

The foregoing description of preferred embodiments of the present invention has been provided for the purposes of illustration and description. It is not intended to be exhaustive or to limit the invention to the precise forms disclosed. Obviously, many modifications and variations will be apparent to practitioners skilled in this art. The embodiments were chosen and described in order to best explain the principles of the invention and its practical application, thereby enabling others skilled in the art to understand the invention for various embodiments and with various modifications as are suited to the particular use contemplated. It is intended that the scope of the invention be defined by the following claims and their equivalents.

Additional Digital Color Methods

Figure 19:
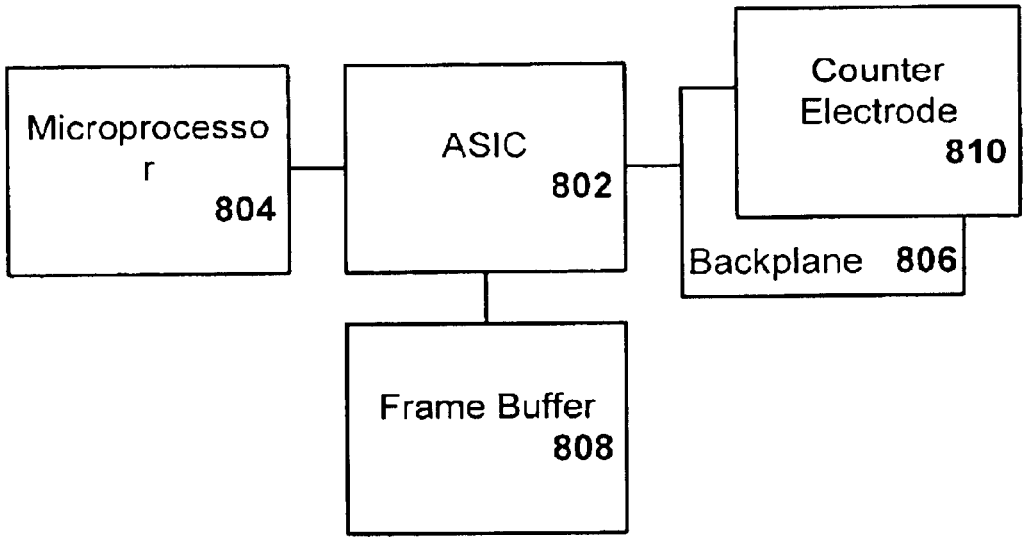
FIG. 19 shows a block diagram of a display system employed in the present invention.

The present invention also relates to the incorporation of various algorithms into memory resources and their utilization in display systems to control data flow and operation of a display system. FIG. 19 shows a block diagram of a display system that may be used in the present invention. It should be noted that other configurations of displays, including those set forth above, may be used in practicing various embodiments of the present invention.

ASIC 802 is designed to take standard, bit-mapped data from the host system, either directly from the microprocessor 804 or by an interface circuit (not shown), and separate this data into separate color components (e.g., red, blue and green). These components are stored as separate color sub-images so that they may be supplied to the backplane 806 to generate each red, blue and green image (color fields) needed for sequential color definition.

Given the compact size of a microdisplay, it may not be feasible to build sufficient memory into the backplane 806 to support displaying images with a large number of colors. As a result, an external memory is used, such as a frame buffer 808, in conjunction with a custom integrated circuit (ASIC) to rapidly provide this information to the backplane 806. Color information is supplied in a format well suited for the different algorithm of the present invention to be used. The hardware and software work together in combination with the algorithms of the present invention.

In separating and storing color data, various types of image processing, such as spatial dithering, may be applied to the data either before or after the image data is separated into the color fields. This storage can either take place within the ASIC chip 802 or on a separate frame buffer chip 808 (memory) connected to the ASIC.

A second feature of the ASIC 802 is its ability to rapidly send each color field to the backplane 806 in a specific sequence as may be required for a given algorithm. As is described herein, the algorithms of the present invention involve different applications of individual bits of color field data, depending on the method. These various methods have been optimized for color generation under various device designs, environmental conditions and color requirements, and refresh rates. Data transfer bit sequencing, timing and clock speeds can be set by the ASIC chip.

Since backfield chip operating voltages can be limited, this architecture allows for voltages supplied to the counter electrode 810 to be offset so that only the change in voltage required for liquid crystal transitions need be applied. The counter electrode offset voltage must be supplied for both positive and negative liquid crystal voltages, as needed to possible negative effects caused by steady state (DC) voltage components. The counter-electrode 810 signals originate on the backplane chip 806 and the voltage levels are set by an additional driver chip (not shown in FIG. 19). The ASIC chip 802 can work with the backplane 806 to determine when and how the counter-electrode voltage is altered, as will be discussed in the description of the drive methods.

A black and white image may be presented on a field sequential color display by presenting the same image bit pattern during Red, Green, and Blue sequential illumination. Pixels optically off will appear black, while those optically on will appear white. The image data requires only 1 bit per pixel and this data may be sent to the backplane once for all three color fields.

The addition of a programmable 2×3 bit lookup table in the ASIC 802 provides a means of mapping colors to substitute for black and white image information, i.e. yellow text on a blue background. The table contains one bit for each primary color (RGB) to substitute for "black" bits, and one bit for each primary color to substitute for "white" bits, in the monochrome image data. The backplane then stores the substituted 3 bit color for each bit written to it. The amount of data written to the backplane is still one bit per pixel, but the backplane can now present three substituted values, one for each of the color fields.

The 2×3 bit lookup table need not be restricted to use as color substitution in monochrome images. For higher color applications, this same table can be used as a means of generating a unique LC drive method.

1. Balanced Binary Color Method

A method is provided for suppressing image brightness flicker. This method is referred to herein as the Balanced Binary Color (BBC) method. This method may be used with high color applications where there is a need to suppress image brightness flicker. The method can be used for color images or monochrome images by simply choosing the correct color field sequence. For example, normal color can be obtained by using the method to apply different color sub-images for red, green and blue color fields. The same data for each color field can be used for monochrome images of a black and white nature. Single color images will require only one color field. Other combinations are possible.

Furthermore, the core of this method is the way a single bit of color is generated. At this bit level, the method can be applied to other color schemes.

According to the BBC method, each bit is used to generate a voltage across the liquid crystal, and then illuminate the resulting full color field by an LED flash supplied to the full backplane chip image area. The duration of the LED pulse provides a binary decoding. For example, the first pulse may be of 1 unit duration and represent the least significant bit of color information. The next bit is then applied and the LED is flashed for 2 units of duration representing the next most significant bit. This is followed by a bit of data and an LED flash 4 units in duration, and so on.

The BBC method can be used to reduce viewing artifacts, such as flicker and contrast reduction, due to residual ionic contamination of the liquid crystal material.

The method will now be described in greater detail. Since the different color fields used in a multi-color image are defined sequentially and similarly, it is sufficient to describe color generation for only one color field—that is, for one complete sub-image of all one color.

Color depths can range from one to eight or more bits of color per color field. This corresponds to from 2 to 256 shades of color for the color field. Consider the example of 4 bits, or 16 shades of color when decoded using binary counting. For a fully digital backplane design, such as the one described in application Ser. No. 09/311,804 (which is incorporated herein by reference in its entirety), only one bit at a time can be applied to the pixel electrode.

One aspect of the invention relates to how each bit is applied at the pixel electrode and counter electrode prior to and during the LED flash. According to the BBC method, each bit used to generate color is applied in a manner that uses either zero applied voltage or equal plus and minus voltage pulses such that no net DC voltage component is applied.

Previous methods employing an analog backplane have not been able to do this, usually due to the need to apply an analog voltage at each pixel. An analog voltage is not easily inverted and typically is inverted only on the subsequent frame (consisting of the full 3 color fields). Digital methods have successfully applied inverted pulses at the bit level by means of alternating control voltages over the entire image area.

By contrast to these previous methods, local memory storage bits are used to alternate between the desired plus and minus voltages in the present invention. This is combined with a period of zero applied voltage at all pixels. The resulting waveform provides an extremely fast response with virtually total immunity to flicker due to device artifacts such as ionic contamination.

The previously discussed 2×3 bit lookup table is employed during the loading of image bit-plane data. Assuming that "0" represents a pixel state of 0 volts, and "1" represents positive voltage, the table is programmed as set forth in Table 1:

TABLE 1

| Input Bit | Sub [1] | Sub [2] | Sub [3] |
|---|---|---|---|
| 0 | 0 | 1 | 0 |
| 1 | 1 | 0 | 0 |

The first two values, Sub[1] and Sub[2] could also be viewed as "data" and "not data". Note that the Sub[3] bit is the same regardless of input data. This data, when switched to the backplane pixels causes all pixels to go to zero volts. Because the Sub[3] bit plane is always written with 0's, new image data can be written (changing Sub[1] and Sub[2]) while the Sub[3] bit plane is switched to the pixel array without affecting the LC.

Figure 20:
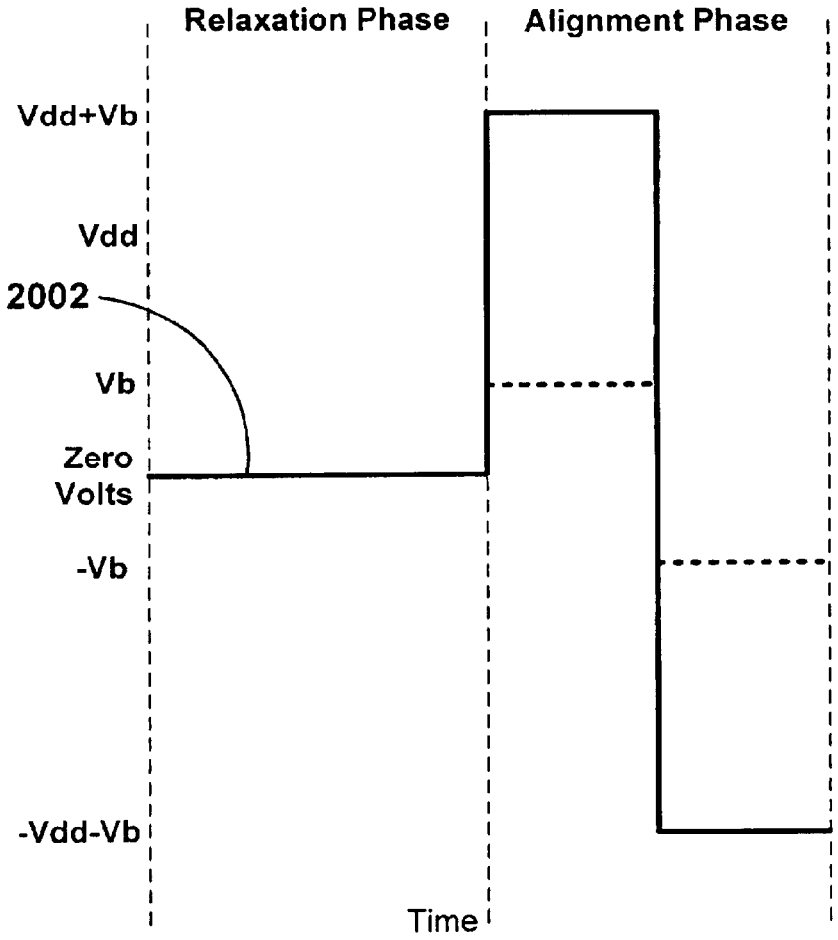
FIG. 20 illustrates single color bit dynamics.

FIG. 20 illustrates single color bit dynamics. As shown in FIG. 20, at the beginning of each bit of color, all pixels in the image array are switched to zero volts on the pixel electrode. The command for this action (select Sub[3] bit plane) originates in the ASIC chip 802 and is carried out by the backplane 806, but may also be carried out entirely by the backplane 806 if circuit densities permit sufficient control and storage on the backplane 806 so as to negate the need for a separate ASIC chip 802. During this period of zero applied voltage, the liquid crystal molecules are strongly switched into their normal state by the anchoring forces supplied by the alignment layers located at the pixel electrode and the counter electrode. The normal state may result in either a normally bright or a normally dark state in the full display system, depending on the light path, polarizers employed and the type of electro-optic liquid crystal mode. The BBC method works effectively in either case. During this zero voltage phase the most rapid possible return to the normal state is realized since any applied voltage during this period would only serve to slow the return of all pixels due to counter acting forces tending to orient the molecules away from this state. This zero voltage phase lasts for a time long enough to allow the liquid crystal molecules to mostly relax to the normal state and may be on the order of a millisecond in duration.

During the zero voltage phase, two bits of data (Sub[1] and Sub[2]) are supplied to the local storage at each pixel location. These data bits are complimentary and represent a 01 or a 10 pair. For purpose of example, suppose that we associate a 01 pair with a dark pixel and a 10 pair with a bright pixel. Let us further suppose that the normal state is bright. Then zero 01 pair, for example, can be associated with a Vdd pixel voltage followed by a zero pixel electrode voltage. During this time, the counter electrode will first be set at −Vb (during the pixel "0") and then at Vdd+Vb (during the pixel "1"). The result will be a high voltage of magnitude Vdd+Vb applied during the full data phase. If we measure the applied voltage across the liquid crystal at the pixel electrode with the counter electrode as a reference, then the voltage would follow the dark line 2002 in FIG. 20, first reaching a value of Vdd+Vb and then an equal and negative voltage of −Vdd−Vb. The liquid crystal molecular orientation responds only to the magnitude of this voltage and so it is acted on by a uniform orienting force during the data phase. In this example, the result would be a dark bit value for this particular pixel.

Other pixels, if they were loaded with a 10 pair would have first zero pixel electrode voltage, then Vdd pixel electrode voltage applied. The counter electrode, since it is common to the entire pixel array, would again see −Vb (during the "1") followed by Vdd+Vb (during the "0"). This would produce a net voltage of magnitude Vb across the liquid crystal material. If Vb is chosen low enough to maintain the liquid crystal in the normal state, a bright bit value for this pixel would result. The voltage measured across the liquid crystal in this case is shown by the heavy dashed line.

The result is a balance of the applied voltage, and the resulting electric field, at each pixel and for each individual bit comprising the color image. This allows extremely little time for ion migration to occur and affect the desired performance. Since these effects can occur on timescales associated with a single polarity of applied voltage, this method can reduce such timescales to the sub-millisecond range. Contrast this to the analog method where a single polarity of applied voltage is applied during each color field. The polarity is not reversed until the next full color frame. Thus a 60 frame per second analog display would see a balanced voltage pulse applied at a rate of only 30 times per second since 2 frames are necessary. Thus the BBC method balances the applied voltages over timescales up to 50 times faster or more. In fact, extremely high speed operation, with multiple alternating drive voltage swings during each bit, could be achieved in situations where the electronics can support this operation.

Another important effect of the BBC method is that it can be very fast. Relaxation to the normal state occurs as fast as possible under zero voltage conditions. And alignment to the driven state occurs under a full voltage pulse, not the partial voltage typical of analog schemes.

It should be noted that this method is not limited to the specific assignments used in the example. The 01 or 10 pairs can be associated with pixel voltages differently, along with the counter electrode voltage, as long as the result is a magnitude Vdd+Vb net liquid crystal voltage for driven states and a magnitude of Vb for normal states during the data phase. Normal states can be either bright or dark and driven states can likewise be chosen to be the corresponding opposite to any normal state.

Figure 21:
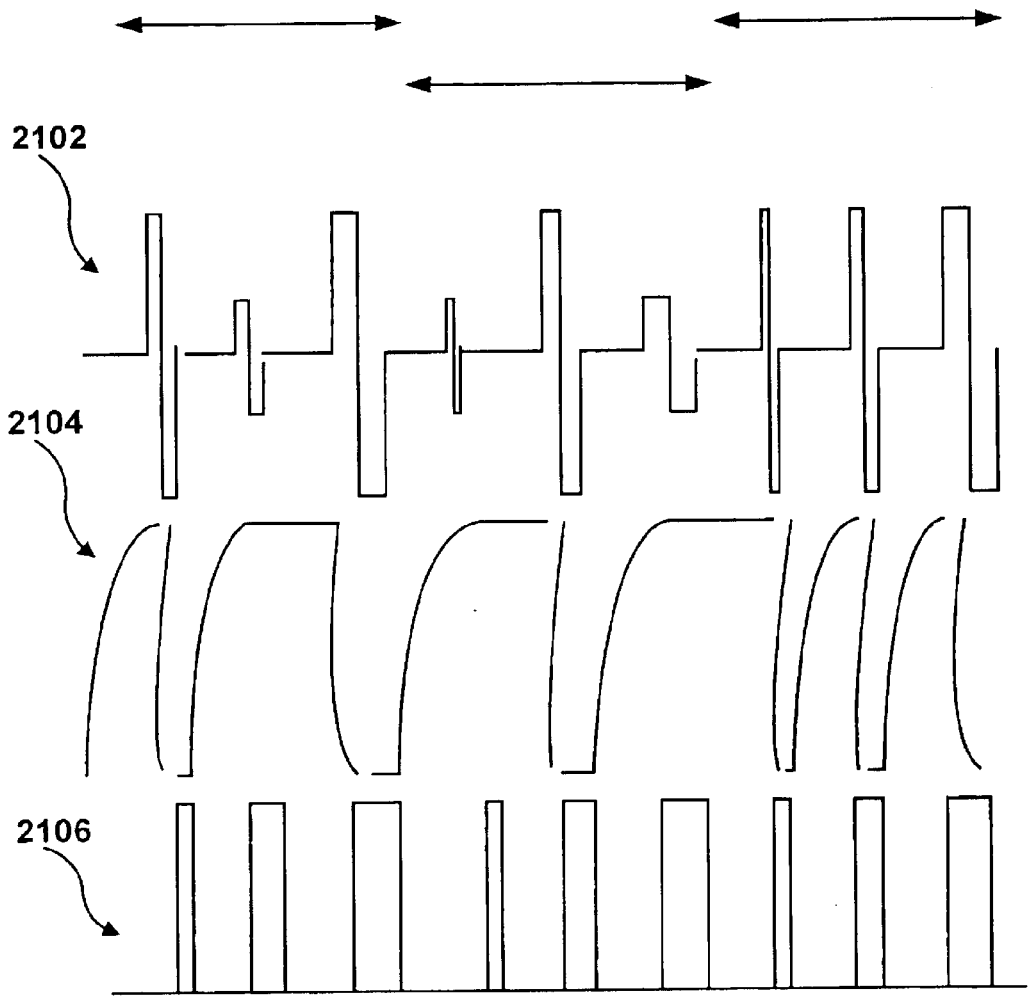
FIG. 21 illustrates how the BBC method is used to produce a single RGB (red, green, blue) color frame.

FIG. 21 illustrates how the BBC method is used to produce a single RGB (red, green, blue) color frame. The top curve 2102 shows the voltage at the liquid crystal. The middle curve 2104 shows the liquid crystals response to this voltage. The bottom curve 2106 shows the LED flash sequence with binary weighted flash duration. A single full frame of red, green and blue is shown for the case were 3 bits of data are applied for each of the red, green and blue colors. This would produce 512 colors total, after the eye and brain of the viewer fuses the temporally separate color images. The number of bits in the example is arbitrary. Total time for each color field is approximately:

$$N[(rise\ time)+(fall\ time)]$$

where N is the number of bits being displayed per color.

Accordingly, an image generation system is provided. A display matrix is provided and has a plurality of display elements which can include liquid crystal. Each display element includes a pixel. A plurality of display circuits are electrically connected to a display element. A plurality of memory cells are associated with each of the circuits, or form part of the circuit, and a selector continuously electrically connected to more than one of the plurality of memory cells, the selector outputting to the pixel data from one memory cell at a time. Peripheral control circuits preferably control read and write operations to the memory cells.

According to this embodiment, the virtual image display system further includes a light emitting mechanism, which may be a mechanism provided at each pixel, a light modulating mechanism provided at each pixel, and/or an illumination source for illuminating the pixels. Logic suppresses image flicker utilizing balanced binary color. The same data can be used to display monochrome and color information.

According to the present invention, each memory cell is divided into a bit that is used to generate a voltage across the liquid crystal and illuminate a color field using an LED pulse. Preferably, the duration of the LED pulse provides a binary decoding. Alternatively or in addition to providing the binary decoding, the pulse can have a set duration and represent a bit of color information. n pulses of n duration may be applied where each pulse represents the n most significant bit of color information.

The system reduces viewing artifacts due to residual ionic contamination of the display material. A balance of an applied voltage and a resulting electric field form a color image rapidly which diminishes the time for ion migration and enhances the color image quality. A polarity reversal to a voltage applied to a liquid crystal is decoupled from a display update frequency.

Figure 22:
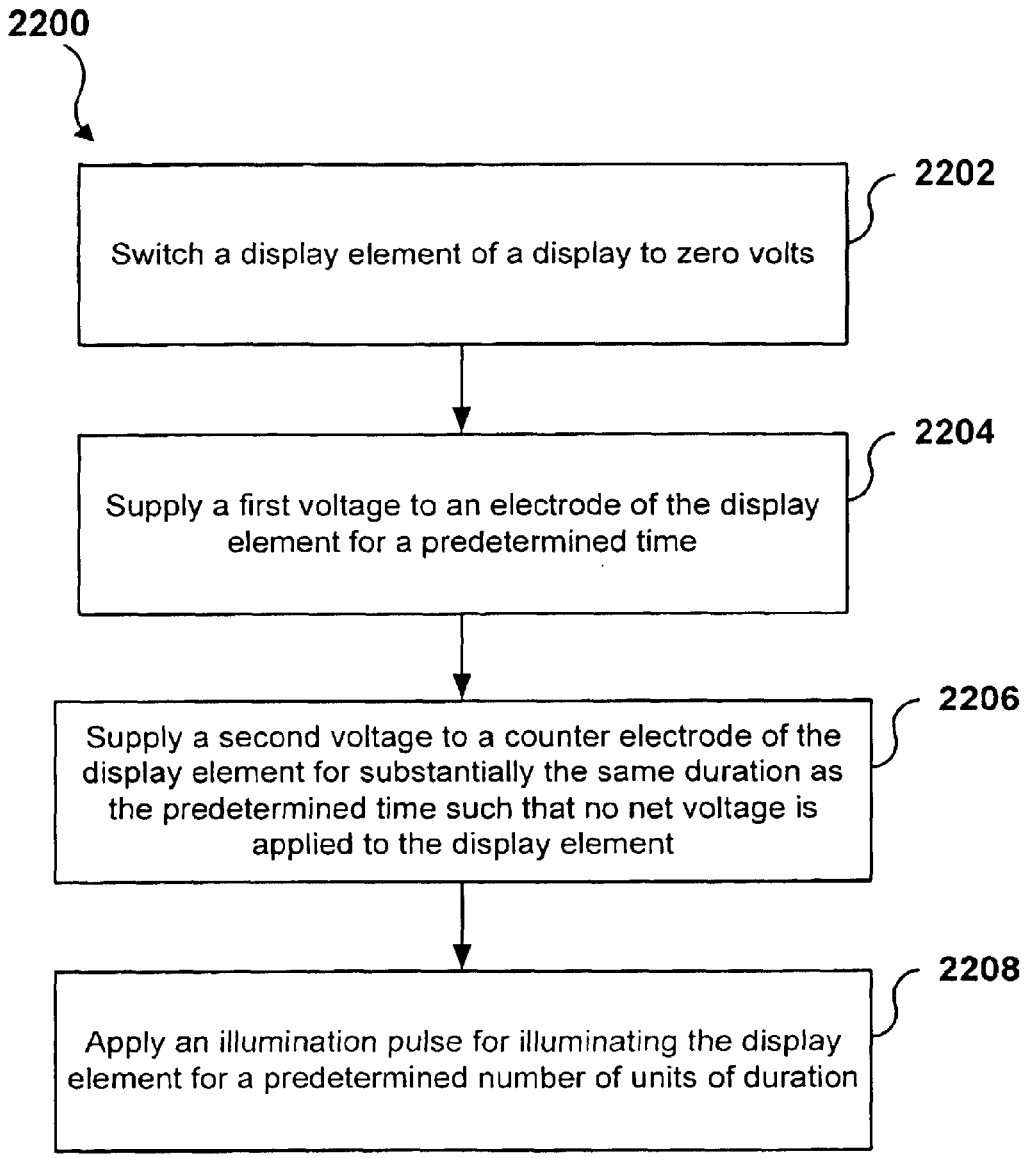
FIG. 22 is a flow diagram of a process for generating an image utilizing balanced binary color.

FIG. 22 is a flow diagram of a process 2200 for generating an image. In operation 2202, a display element of a display is switched to zero volts for a first duration of time, where the display element includes a pixel. A first voltage is supplied to an electrode of the display element for a second amount of time in operation 2204. In operation 2206, a second voltage is supplied to a counterelectrode of the display element for a third period of time such that no net voltage (i.e., $V_1+V_2=0$) is applied to the display element across the sum of the time periods. The second voltage may be of a substantially equal magnitude and can be supplied to the counterelectrode for about the same time as the aforementioned predetermined time. An illumination pulse is applied to the pixel in operation 2208 for illuminating the display element for a predetermined number of units of duration where the units of duration can be in fractions of milliseconds, etc. This process can be repeated for each bit of color information to be displayed.

2. Digitally Controlled Waveform Method

Another method according to the present invention is the Digitally Controlled Waveform (DCW) method. This method may be used independently of the BBC method or in conjunction with it.

According to the present invention, the DCW method can be performed by controlling individual bit responses using the techniques of the BBC method and a simple binary digital application of the data.

The DCW method is desirable when response speed is important, such as at lower temperatures. By contrast, the full BBC method is more desirable when it is needed to reduce flicker.

Figure 23:
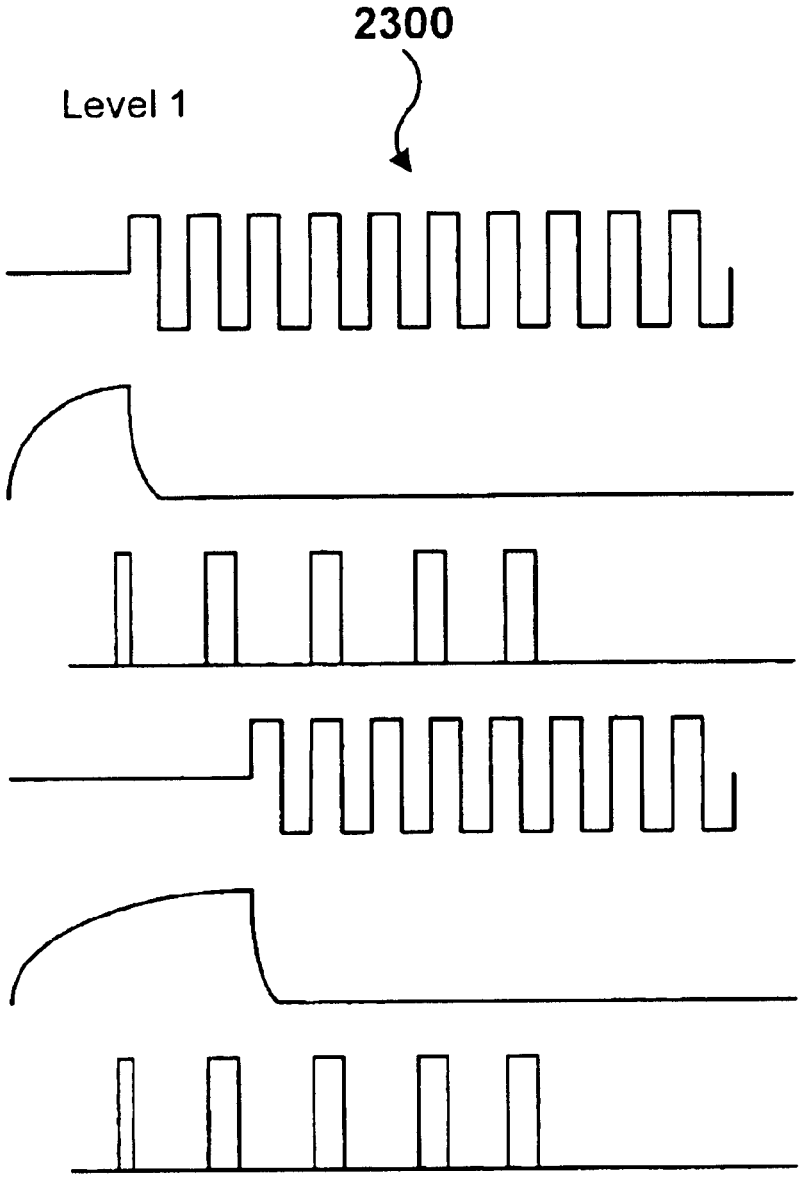
FIG. 23 illustrates the basic shape of a waveform according to the DCW method.

The DCW method's response time advantage is made possible by only requiring a single rise and fall time for each color field, rather than one per color bit as needed in standard binary methods. The relaxation time (rise time for a display that is normally white) may or may not occur at zero volts in this method, and so the relaxation time could be somewhat longer. Nevertheless, the method still has a strong overall advantage in terms of response time due to the single waveform approach. The basic shape of the waveform 2300 is shown in FIG. 23.

According to the method, 4 bits of data are used to display a 3 bit color image field for every pixel. The waveform consists of a single rise and fall waveform incorporating from zero to 4 LED flashes depending on the value of the 4 data bits. This scheme is able to fully display the shades of color produced by 3 data bits at the frame buffer. The 3 data bits produce 8 levels of color for the red, blue or green color fields. These 8 levels correspond to values of 0 to 7 in intensity. These 8 levels can be represented by various combinations of LED flashes of weight 1, 2, 2, and 2. The 4 bits supplied by the ASIC to the backplane map the original 3 bits into the new 4 bit space with only a single rise and fall. Table 2, below, shows an example of the mapping:

TABLE 2

| Original 3 Bits | Value | 4 Bit Sequence (1 + 2 + 2 + 2) |
|---|---|---|
| 000 | 0 | 0000 |
| 001 | 1 | 1000 |
| 010 | 2 | 0001 |
| 011 | 3 | 1100 |
| 100 | 4 | 0011 |
| 101 | 5 | 1110 |
| 110 | 6 | 0111 |
| 111 | 7 | 1111 |

As can be seen from Table 2, the waveform has only a single rise and fall.

It is noted that the exact shape of the waveform only indirectly controls the intensity value. This is due to the use of the waveform as an envelope to include the appropriate LED pulses of duration 1 and 2 units. To the degree that the waveform approaches a square wave, the coupling can be very weak. For finite rise and fall times, some interaction between the LED flashes and the waveform shape occurs. Because of this, the first LED flash of unit duration may be made slightly longer to compensate. Other adjustments can be made to achieve the most faithful representation of the original 8 levels. For a full color frame of data, similar sequences are strung together for red, green and blue color fields. Note that no special voltage pulses are required. Also, this technique relies on the use of local data storage for each pixel. The write times for these pixels can be invisible as long as the data transfer rate from the ASIC and frame buffer is faster for each bit than either rise or a fall, but not the sum of rise and fall. This is due to the need only to begin or end the single waveform before or after an LED pulse.

The total duration of a color field is may be expressed by:

$$(\text{rise time})+(\text{fall time})+3(\text{max time})$$

where max time is the maximum of rise time or fall time.

A variation on the above scheme maps 3 bits (8 levels) into a total of 5 bits on the backplane. With this method the total field time can be reduced to:

$$(\text{rise time})+4(\text{fall time})$$

where rise time>fall time.

To make this work, one must compensate for the fact that insufficient time is allowed for the initial waveform rise for values of 2, 4, and 6 color shade. Therefore, a fifth compensation bit is provided and turned on for these values. The modified table below shows the mapping:

TABLE 3

| Original 3 Bits | Value | 5 Bit Sequence (1 + 2 + 2 + 2 + compensation) |
|---|---|---|
| 000 | 0 | 00000 |
| 001 | 1 | 10000 |
| 010 | 2 | 00011 |
| 011 | 3 | 11000 |
| 100 | 4 | 00111 |
| 101 | 5 | 11100 |
| 110 | 6 | 01111 |
| 111 | 7 | 11110 |

The waveforms of FIG. 23 include this compensation bit. For cases where the falltime is much less than the risetime, this method can be considerably faster. Consider the case of 0.5 millisecond falltime and 1.0 millisecond risetime. Then the compensated DCW method requires 3 milliseconds per color field and frame rates approximately as high as 111 frames/second can be achieved. Alternately, lower temperature operation can be provided at 60 frames/second. Compare this to 3 bits per color with standard binary methods where 3 (1.5 milliseconds) are needed per field, resulting in a maximum frame rate of 74 frames/second.

Figure 24:
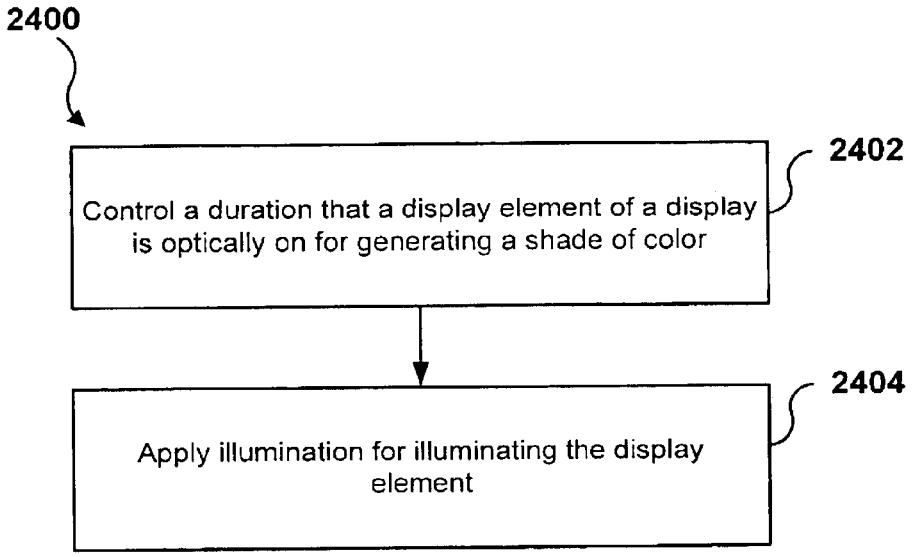
FIG. 24 is a flowchart of a process for generating an image utilizing a digitally controlled waveform.

FIG. 24 is a flowchart of a process 2400 for generating an image. In operation 2402, a shade of color is generated by controlling a duration that each display element is optically on. Illumination is applied to illuminate the display element in operation 2404.

In a preferred embodiment, an additional data bit is used to display a color image field for each pixel. According to an embodiment, n flashes corresponding to the value of the data in the memory cell are used to vary the intensity of the image display. A single rise and fall time can be used for a color field to enhance image processing, and this does not have to be dependent upon the number of bits employed. Preferably, the width of a pulse defines a grayscale of a color. Thus, the width of a voltage pulse can be used a grayscale of color. Alternatively, one or more illumination pulses can be applied to the display element for illuminating the display element for generating a shade of color, one pulse for each data bit in a sequence of data bits of a color field.

3. Analog Controlled Waveform Method

In Active-Matrix panels, RGB levels are stored into the array as analog voltage levels. These levels control directly the voltage applied to liquid crystal between pixel and ITO layer to produce the various shades of color under constant illumination. The voltage level of each pixel is maintained by the active-matrix circuit until a new value is applied to the pixel.

Red, green, and blue component sub-pixels are simultaneously applied to the LC as a group to form a single pixel. Variations in color response of the LC is accounted for in each pixel, rather than by different voltage levels of ITO.

Binary control of LC avoids many complications of analog drive methods. Analog control is far more sensitive to variations in cell gap, temperature, and LC contaminates, requiring high levels of quality control during manufacture.

However, binary methods have inherently been more limited in terms of color depth due to optical response time of ordinary LC. This limitation can be substantially overcome by application of a variation of the DCW drive method as set forth in the section above entitled "Digitally Controlled Waveform Method."

Rather than following the prior art method of applying the analog voltage to drive the Liquid Cystal (LC) to various points on the EO curve to produce shades of color, the voltage (at each pixel) is compared to a reference voltage input to the LC to control the duration that the LC is "optically on", such as in a similar manner as set forth above in the section entitled "Digitally Controlled Waveform Method." For each frame (or field when using field sequential color), all pixels in the matrix are allowed to become optically on (or off) prior to the application of illumination. When illumination is applied, the reference voltage is changed over time, causing each pixel to change state (optically on to off, or off to on) at the precise time that its voltage value matches the reference level. It should be noted that the matching value may instead be a threshold differential value for the transistor used as the analog computer.

For field sequential color, the analog levels of RGB can be individually selected (multiplexed) over time for presentation to the analog comparitor. The output of the comparitor controls the state of a single pixel, which is illuminated with the appropriate color in the field sequence.

Since the output of such an arrangement is essentially digital, local pixel inversion can be applied in concert with ITO inversion to allow for the benefits of AC driving of the LC.

The described circuit and method can be applied as an improvement to all existing implementations of analog active matrix LC panels and cells. The described circuit may be equally applicable as an improvement to non-active matrix implementations of analog LC panels and cells as well as to MEMS displays and other types of displays.

The described circuit may have direct application to control color levels in OLED displays. In this case, OLEDs may be driven digitally in their optimum illumination range, resulting in potential power savings and simplified color level control. Additionally, by separating pixel groups into multiple phased cycles, power consumption can be spread evenly over time. These grouped pixels may, of course, be physically interspersed on the display to avoid flicker a low update rates.

Figure 25:
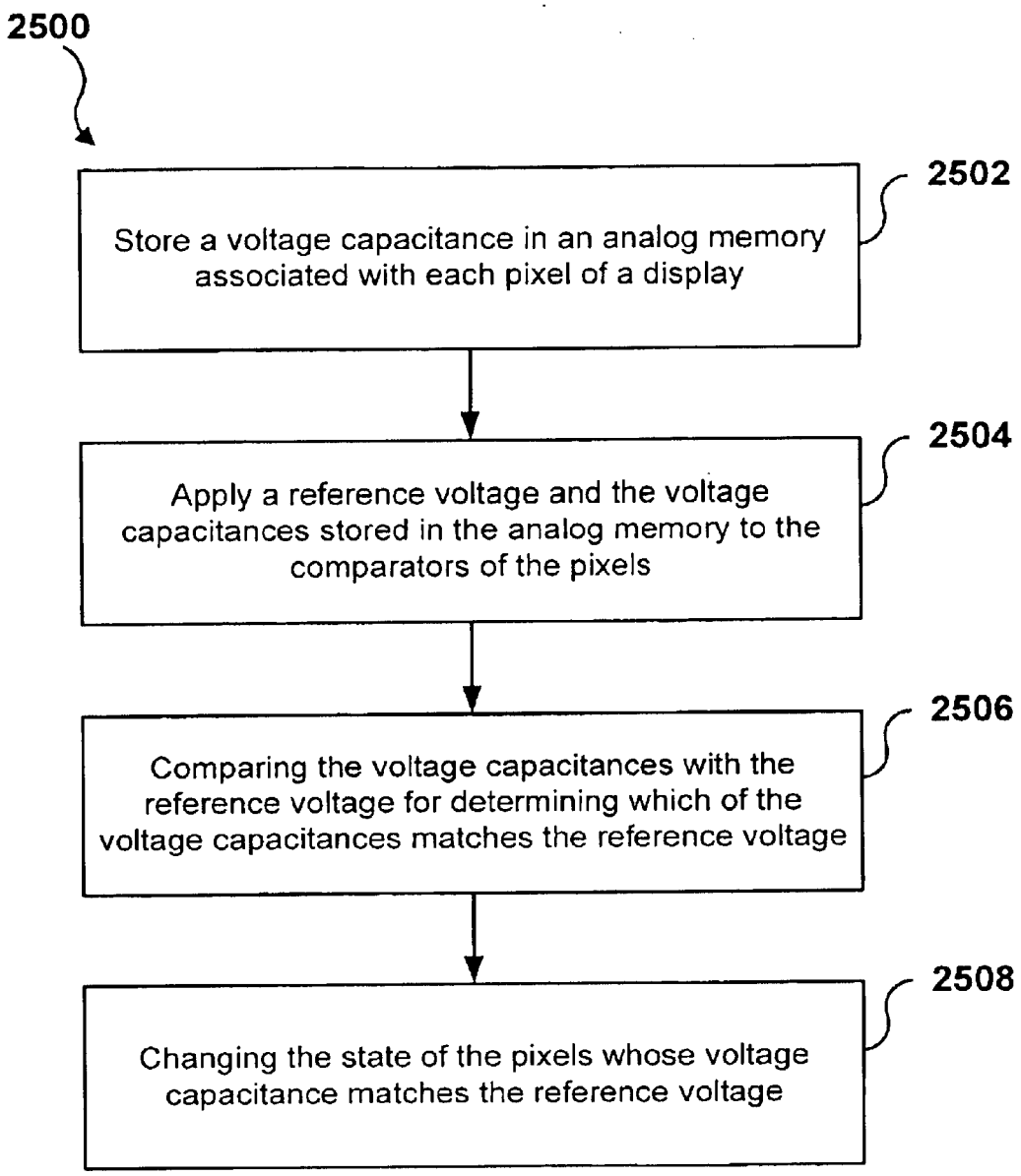
FIG. 25 is a flow diagram of a process for driving a display utilizing an analog controlled waveform.

FIG. 25 is a flow diagram of a process 2500 for driving a display. In operation 2502, a voltage capacitance is stored in an analog memory associated with each pixel of a display, where each of the pixels also has a comparator associated with it. Note that there may be single memory cells for each pixel. A reference voltage and the voltage capacitances stored in the analog memory are applied to the comparators of the pixels in operation 2504. In operation 2506, the comparators are used to compare the voltage capacitances with the reference voltage for determining which of the voltage capacitances matches the reference voltage. The state of the pixels whose voltage capacitance matches the reference voltage is changed in operation 2508.

Again, the display can be an active matrix panel display as well as a non-active matrix display, OLED display, or other type of display. As an option, illumination may be applied after the actuation of the one or more pixels. The reference voltage can be changed as a function of time to cause each pixel to actuate and de-actuate at a desired time. Groups of the pixels can be actuated. In such case, the groups of pixels are actuated in multiple phased cycles. Preferably, the groups are interspersed on the display to avoid flicker at low update rates.

4. SuperFrame Dithering Method

Figure 25A:
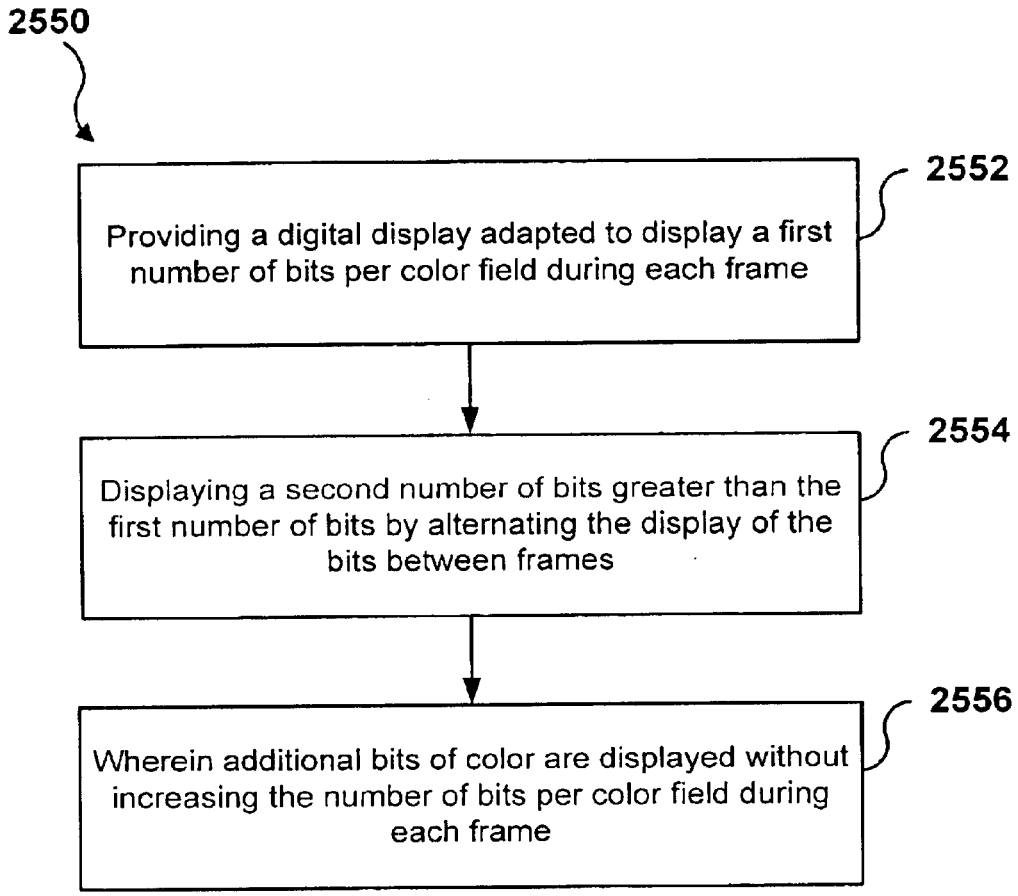
FIG. 25A illustrates a method for SuperFrame Dithering in accordance with one embodiment of the present invention.

Another method, referred to herein as the SuperFrame Dithering (SFD) method. FIG. 25A illustrates a method 2550 in accordance with SFD. Such method 2550 may be used for driving a digital display adapted to depict a first number of bits per color field during each frame. See operation 2552. In use, a second number of bits is displayed which is greater than the first number of bits, as indicated in operation 2554. This is accomplished by alternating the display of the bits between frames. More information relating to such alternating technique will be set forth hereinafter in greater detail. To this end, additional bits of color are displayed without increasing the number of bits per color field during each frame. See operation 2556. For example, the method enables N+M bits of color to be displayed using N digital bits per color field where M is 1, 2, 3 or more.

According to the method, N+M bits of color are applied to N digital bits per color field over several frames where the M bits of additional color are applied in a spatially distributed manner so as to reduce the amount of brightness modulation that is observed.

The SFD method may or may not be used with the BBC method. In order to understand how the SFD method adds a bit per color (N+1) to a N bit/color drive method, imagine that four bits of color data are stored in the frame buffer. To display the fourth bit using a 3 digital bits, the value of the fourth bit of data may be added to every other frame where the third bit of the data would appear. Table 4 below illustrates the case for the example where the three most significant bits are 010 for both a 0 and a 1 fourth bit value over sequential frames.

TABLE 4

| Frame | Data = 0100 Pixel Values | Data = 0101 Pixel Values |
|---|---|---|
| A | 010 | 010 |
| B | 010 | 011 |
| A | 010 | 010 |
| B | 010 | 011 |
| A | 010 | 010 |
| B | 010 | 011 |

When one averages what is observed over time, the perceived pixel values for three bits as shown above correspond to the four bit pixel values. In other words 010 and 011 average to the binary value 0101 as long as we apply the most significant bits with the same weighting for 3 or 4 bit numbers. Physically, the same effect on average is achieved that would be achieved by adding one more binary data cycle with a flash duration half as long as the original third bit's flash duration.

One problem with the above-described method is that the intensity varies at half the frame rate. As a result, flicker may be perceived. For example, at a frame rate of 90 frames/sec, the third and fourth bit would appear at only 45 cycles/sec. This could result in flicker since the viewer would observe brightness modulation at 45 cycles/sec, well into the range where most viewers are very sensitive to flicker.

In order to address this problem, the SFD method further includes spatially distributing when the additional bit is displayed so that the additional bit is not displayed by all the pixels at the same time. Since the human vision system responds more slowly to data with fine detail, spatially offsetting the frames where the additional bit is being displayed reduces the perceived flicker.

FIGS. 26 shows one method for achieving a spatial offset. As illustrated in FIG. 26, each group of 2 pixels along a row or column contains pixels with both A and B frames.

By not showing a given frame across an image at the same time, the intensity modulation is not perceived. This is easy to see for the case of a region of uniform color. The viewers averages over time and so the full resolution of the image is realized. The possible artifact of flicker is minimized due to the averaging over adjacent pixels. This allows the use of temporal dither at color depths that would otherwise not be possible due to the perceivable amount of intensity fluctuation at half the frame rate.

Two bits of temporal color can also be added. The pixel values are shown in Table 5:

TABLE 5

| Frame | Data = 01000 Pixel Values | Data = 01001 Pixel Values | Data = 01010 Pixel Values | Data = 01011 Pixel Values |
|---|---|---|---|---|
| A | 010 | 010 | 010 | 011 |
| B | 010 | 011 | 011 | 011 |
| C | 010 | 010 | 010 | 010 |
| D | 010 | 010 | 011 | 011 |
| A | 010 | 010 | 010 | 011 |
| B | 010 | 011 | 011 | 011 |

TABLE 5-continued

| Frame | Data = 01000 Pixel Values | Data = 01001 Pixel Values | Data = 01010 Pixel Values | Data = 01011 Pixel Values |
|---|---|---|---|---|
| C | 010 | 010 | 010 | 010 |
| D | 010 | 010 | 011 | 011 |

The values shown above for the sequence of four different frames is not unique but is shown for illustration. FIG. 27 shows a method of spatially staggering these values under the assumption that a pixel at an "A" value becomes "B" on the next frame, "B" becomes "C", "C" becomes "D" and "D" becomes "A" as we cycle from frame to frame. This pattern in effect is a phasing of the data and the same process is applied to all 3 color fields in the frame. When the image is averaged over four adjacent pixels, any square or along any row or column, the correct value is realized for the vast majority of locations in the array at any point in time. This will be true for all frames as well. The correct value will also be realized for any pixel when averaged over 4 frames. For example, a display operating at a frame rate of 80 frames/second will generate the correct intensity perception if the user can average over four frames. The flicker which could be perceived as low as 20 cycles/second is suppressed by the spatial averaging. Various other spatial averaging schemes are possible.

The foregoing description of preferred embodiments of the present invention has been provided for the purposes of illustration and description. It is not intended to be exhaustive or to limit the invention to the precise forms disclosed. Obviously, many modifications and variations will be apparent to practitioners skilled in this art. The embodiments were chosen and described in order to best explain the principles of the invention and its practical application, thereby enabling others skilled in the art to understand the invention for various embodiments and with various modifications as are suited to the particular use contemplated. It is intended that the scope of the invention be defined by the following claims and their equivalents.

What is claimed is:

1. An image generation system, comprising:

(a) a plurality of display elements, each display element including a pixel;

(b) a plurality of circuits each electrically coupled to a display element;

(c) a plurality of memory cells associated with each of the circuits and a selector for outputting to the display element from one memory cell at a time;

(d) an illumination source for illuminating one or more pixels in a particular color;

(e) a light emitting mechanism and a light modulating mechanism coupled with each of the one or more pixels; and (f) logic for generating a plurality of sequential frames for displaying N+M bits of color, wherein each of the plurality of sequential frames is generated with only N bits of color such that there are M bits of color difference spatially distributed over M pixel groups of the plurality of sequential frames without increasing the number of bits per color field during each frame.

2. An image generation system as recited in claim 1 wherein additional color are applied in a spatially distributed manner to reduce the amount of brightness modulation that is observed.

3. An image generation system as recited in claim 1, wherein an additional color bit is calculated based on the value of the preceding bit being added to every other frame.

4. The image generation system as recited in claim 1, wherein the digital display is an active matrix panel display.

5. A method for driving a digital display, comprising the steps of:

(a) providing a digital display adapted to display a first number of bits per color field during each frame; and (b) displaying a second number of bits greater than the first number of bits by spatially distributing in each frame a difference of the second number of bits so that an average of the frames represents a combination of the first and second number of bits;

(c) wherein the first and second number of bits of color are displayed without increasing the number of bits per color field during each frame.

6. A method as recited in claim 5, wherein N+M bits of color are displayed using N digital bits per color field.

7. A method as recited in claim 6, wherein additional color are applied in a spatially distributed manner to reduce the amount of brightness modulation that is observed.

8. A method as recited in claim 6, wherein an additional color bit is calculated based on the value of the preceding bit being added to every other frame.

9. A method as recited in claim 6, wherein a given frame is not displayed which results in a reduction of a perceived intensity modulation and flicker reduction.

10. The method as recited in claim 5, wherein the digital display is an active matrix panel display.

* * * * *